US009086658B2

(12) United States Patent
Watanabe

(10) Patent No.: US 9,086,658 B2
(45) Date of Patent: Jul. 21, 2015

(54) IMAGE FORMING APPARATUS

(71) Applicant: FUJI XEROX CO., LTD., Tokyo (JP)

(72) Inventor: Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/161,452

(22) Filed: Jan. 22, 2014

(65) Prior Publication Data

US 2014/0376937 A1 Dec. 25, 2014

(30) Foreign Application Priority Data

Jun. 20, 2013 (JP) ..... 2013-129629

(51) Int. Cl.

| | |
|---|---|
| ***G03G 15/01*** | (2006.01) |
| ***G03G 15/16*** | (2006.01) |
| ***G03G 13/16*** | (2006.01) |

(52) U.S. Cl.

CPC ..... *G03G 13/16* (2013.01); *G03G 15/161* (2013.01); *G03G 15/1675* (2013.01); *G03G 15/0136* (2013.01); *G03G 2215/1661* (2013.01)

(58) Field of Classification Search

CPC ..... G03G 15/161; G03G 2215/1661
USPC ..... 399/66, 71
See application file for complete search history.

(56) References Cited

U.S. PATENT DOCUMENTS

| | | | | |
|---|---|---|---|---|
| 5,708,929 | A * | 1/1998 | Adachi et al. | 399/149 |
| 2009/0263166 | A1* | 10/2009 | Yoshida et al. | 399/299 |
| 2012/0099881 | A1* | 4/2012 | Seki et al. | 399/66 |

FOREIGN PATENT DOCUMENTS

| | | |
|---|---|---|
| JP | A-10-10886 | 1/1998 |
| JP | A-2000-231286 | 8/2000 |
| JP | A-2002-31967 | 1/2002 |
| JP | A-2002-72713 | 3/2002 |
| JP | A-2002-214932 | 7/2002 |
| JP | A-2005-156776 | 6/2005 |

* cited by examiner

*Primary Examiner* — Gregory H Curran
(74) *Attorney, Agent, or Firm* — Oliff PLC

(57) ABSTRACT

An image forming apparatus includes image carriers that carry toner images; an intermediate transfer body that is brought into contact with the image carriers to carry the images before transferring them to a recording material; first transfer devices that include first transfer members and form first-transfer electric fields for transferring the images on the image carriers to the intermediate transfer body; a second transfer device that includes a second transfer member and forms a second-transfer electric field for transferring the images transferred to the intermediate transfer body to the recording material; and an adjusting device that adjusts an electric field to be formed in a second transfer area to a cleaning electric field, which is of the same polarity as and a lower intensity than the second-transfer electric field, when the images on the intermediate transfer body passes through the second transfer area without a recording material passing therethrough.

13 Claims, 23 Drawing Sheets

IMAGE FORMING APPARATUS

CROSS-REFERENCE TO RELATED APPLICATIONS

This application is based on and claims priority under 35 USC 119 from Japanese Patent Application No. 2013-129629 filed Jun. 20, 2013.

BACKGROUND

Technical Field

The present invention relates to image forming apparatuses.

SUMMARY

According to an aspect of the invention, there is provided an image forming apparatus including multiple image carriers that carry images formed with color component toners; an intermediate transfer body that is arranged to face the image carriers and is configured to run in a loop, the intermediate transfer body being brought into contact with at least one of the image carriers used for image forming to carry the image formed on the image carrier before transferring the image to a recording material; first transfer devices that include first transfer members arranged to face an inner surface of the intermediate transfer body, at positions corresponding to the image carriers, the first transfer devices forming first-transfer electric fields in first transfer areas between the first transfer members and the image carriers to transfer the images carried on the image carriers to the intermediate transfer body; a second transfer device that includes a second transfer member arranged to face an outer surface of the intermediate transfer body, the second transfer device forms a second-transfer electric field in a second transfer area between the second transfer member and the intermediate transfer body to transfer, to the recording material, the images transferred to the intermediate transfer body by the first transfer devices; and an adjusting device that adjusts an electric field to be formed in the second transfer area to a cleaning electric field, which is of the same polarity as and a lower intensity than the second-transfer electric field, when the image transferred to the intermediate transfer body passes through the second transfer area without a recording material passing therethrough.

According to the above-described aspect, image defects due to charge record remaining in the intermediate transfer body is reduced without complicating the configuration of the apparatus.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1:
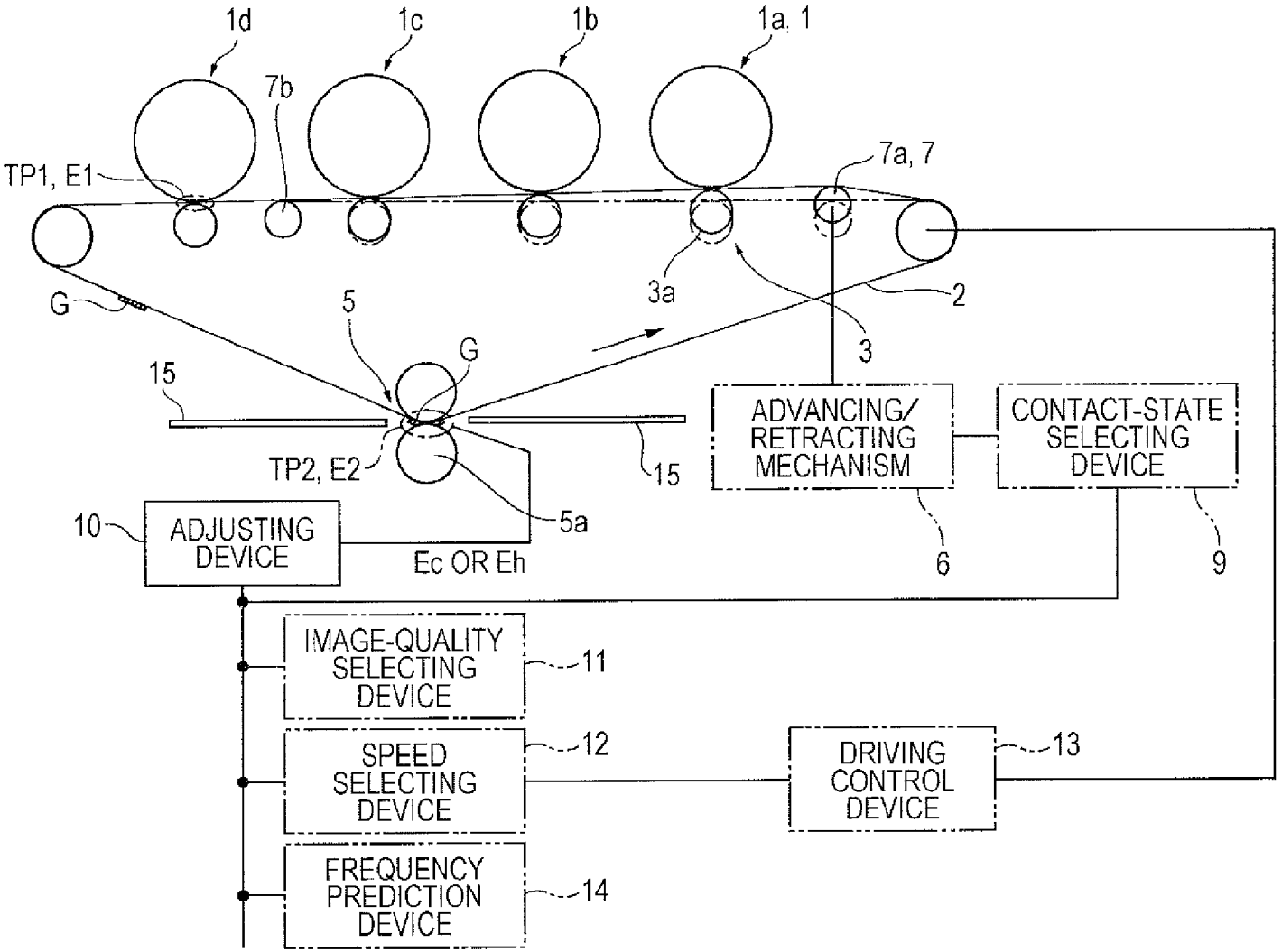
FIG. 1 illustrates the outline of exemplary embodiments of an image forming apparatus of the present invention.

FIG. 1 illustrates the outline of exemplary embodiments of an image forming apparatus of the present invention.

In FIG. 1, the image forming apparatus includes multiple image carriers 1 (in this example, 1*a* to 1*d*) that form and carry images G composed of color component toners; an intermediate transfer body 2 that is arranged to face the image carriers 1 and is configured to run in a loop, the intermediate transfer body 2 being brought into contact with at least one of the image carriers 1 (for example, 1*d*) used for image forming to temporarily carry the image G formed on this image carrier 1 before transferring the image G to a recording material 15; first transfer devices 3 that include first transfer members 3*a* arranged to face an inner surface of the intermediate transfer body 2, at positions corresponding to the image carriers 1, the first transfer devices 3 forming first-transfer electric fields E1 in first transfer areas TP1 between the first transfer members 3*a* and the image carriers 1 to transfer the images G carried on the image carriers 1 to the intermediate transfer body 2; a second transfer device 5 that includes a second transfer member 5*a* arranged to face an outer surface of the intermediate transfer body 2, the second transfer device 5 transferring the images G transferred to the intermediate transfer body 2 by the first transfer devices 3 to the recording material 15 by forming a second-transfer electric field E2 in a second transfer area TP2 between the second transfer member 5*a* and the intermediate transfer body 2; and an adjusting device 10 that adjusts an electric field to be formed in the second transfer area TP2 to a cleaning electric field Ec, which is of the same polarity as and a lower intensity than the second-transfer electric field E2, when the images G transferred to the intermediate transfer body 2 pass through the second transfer area TP2 without the recording material 15 passing therethrough.

In this technical solution, this exemplary embodiment deals with a tandem image forming apparatus of an intermediate transfer type, in which multiple image carriers 1 (for example, 1*a* to 1*d*) are arranged along the intermediate transfer body 2.

This exemplary embodiment not only includes a configuration in which only the image carrier 1 used for the image-forming operation (for example, 1*d*) is brought into contact with the intermediate transfer body 2 by a contacting/retracting mechanism 6, but also a configuration in which the multiple image carriers 1 and the intermediate transfer body 2 are constantly in contact with each other.

The first transfer members 3*a* of the first transfer devices 3 may be either transfer rollers that are in contact with the intermediate transfer body 2 or corotrons disposed in a non-contact manner.

The second transfer member 5*a* of the second transfer device 5 may also be either a transfer roller or a transfer belt that transports the recording material 15 nipped with respect to the intermediate transfer body 2, or a corotron disposed in a non-contact manner. When the second transfer member 5*a* disposed in a non-contact manner is employed, a functional member that guides the recording material 15 may be separately provided.

The adjusting device 10 adjusts an electric field acting on the second transfer area TP2 when the image G passes through the second transfer area TP2 without the recording material 15 passing therethrough.

In this exemplary embodiment, the cleaning electric field Ec is of the same polarity as and a lower intensity than the second-transfer electric field E2. If an electric field of opposite polarity is formed, even though the absolute value thereof is smaller than that of the second-transfer electric field E2, it is not enough to eliminate a charge record difference left in the intermediate transfer body 2. Furthermore, if the cleaning electric field Ec is of the same polarity as and has higher intensity than the second-transfer electric field, the charge record difference left in the intermediate transfer body 2 becomes more evident, and the amount of waste toner moved to the second transfer member increases.

Figure 2:
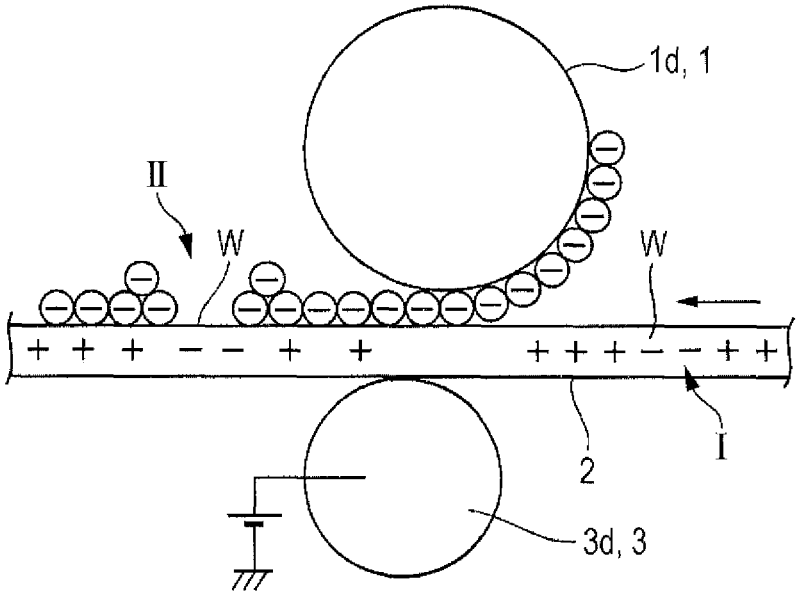
FIG. 2 illustrates a technical problem to be handled by the image forming apparatus according to the exemplary embodiments.

The image forming apparatus according to this exemplary embodiment effectively suppresses a so-called ghost phenomenon due to an image record shown in FIG. 2.

As shown in FIG. 1, in a tandem image forming apparatus of an intermediate transfer type, the intermediate transfer body 2 is subjected to the first-transfer electric fields E1 in the first transfer areas TP1 and is subjected to the second-transfer electric field E2 in the second transfer area TP2. Thus, when a continuous image forming operation is finished and a subsequent image forming operation is started, a charge record (the difference in amount of charge between an image portion and a non-image portion) W resulting from the first and second transfers may remain in the intermediate transfer body 2, as indicated by a reference numeral "I" in FIG. 2.

If this charge record W is large, when, for example, the image carriers 1 form a halftone image G in the subsequent image forming operation, after a portion of the intermediate transfer body 2 having a large charge record W passes through the first transfer areas TP1 of the image carriers 1, toner used to form an image scatters due to the charge record W, as indicated by a reference numeral "II" in FIG. 2, causing unevenness of an image and making image quality defects (i.e., ghost) due to charge record W more evident.

To suppress the ghost phenomenon, this exemplary embodiment is configured to apply a predetermined cleaning electric field Ec to the second transfer area TP2 to reduce the charge record W causing the ghost phenomenon.

The ghost phenomenon is more evident in the intermediate transfer bodies 2 having higher resistances, because such intermediate transfer bodies 2 retain a greater amount of charge.

Next, exemplary or suitable configurations of the image forming apparatus according to this exemplary embodiment will be described.

First, the adjusting device 10 selects such a cleaning electric field Ec that the residual charge difference between the image portion and the non-image portion formed on the intermediate transfer body 2 having passed through the second transfer area TP2 is less than or equal to a predetermined threshold.

The cleaning electric field Ec may be any electric field as long as it is of the same polarity as and a lower intensity than the second-transfer electric field E2, but, ideally, the cleaning electric field Ec may be selected such that the residual charge difference between the image portion and the non-image portion of the intermediate transfer body 2 having passed through the second transfer area TP2 is within a predetermined threshold. Because the level of the image defect (ghost grade) due to an image record (residual charge difference) gradually decreases in accordance with the voltage for forming the cleaning electric field Ec and becomes minimum at a certain voltage, the cleaning electric field Ec may be selected such that the ghost grade is minimized.

Furthermore, the image forming apparatus includes the contacting/retracting mechanism 6 that relatively brings the intermediate transfer body 2 into contact with or retracted from the image carriers 1 such that the image carrier 1 used for the image-forming operation (for example, 1*d*) comes into contact with the intermediate transfer body 2 and such that the image carriers 1 not used for the image-forming operation (for example, 1*a* to 1*c*) are not in contact with the intermediate transfer body 2; and a contact-state selecting device 9 that selects, using the contacting/retracting mechanism 6, a full contact mode, in which the intermediate transfer body 2 is in contact with all the image carriers 1, or a partial contact mode, in which the intermediate transfer body 2 is in contact with at least one, but not all, of the image carriers 1 (for example, 1*d*). When the contact-state selecting device 9 selects the partial contact mode, the adjusting device 10 adjusts the electric field to be formed in the second transfer area TP2 to the cleaning electric field Ec, and when the contact-state selecting device 9 selects the full contact mode, the adjusting device 10 adjusts the electric field to be formed in the second transfer area TP2 to a holding electric field Eh, which serves to hold an image, which is of opposite polarity to the second-transfer electric field E2.

The contacting/retracting mechanism 6 brings the image carrier 1 used for the image-forming operation into contact with the intermediate transfer body 2 and brings the other image carriers 1 away from the intermediate transfer body 2. Although various configurations, such as a configuration in which the intermediate transfer body 2 is moved relative to the fixed image carriers 1, a configuration in which the image carriers 1 are moved relative to the fixed intermediate transfer body 2, and a configuration in which both the image carriers 1 and the intermediate transfer body 2 are moved, are possible, a configuration in which the image carriers 1 are fixed is suitable to precisely form images on the image carriers 1.

Because image quality defects due to charge record remaining in the intermediate transfer body 2 tend to occur in the partial contact mode (for example, when an image carrier for forming a single black toner image is used), the cleaning electric field Ec is formed in the second transfer area TP2 only when the partial contact mode is selected. In the full contact mode, such a charge record remaining in the intermediate transfer body 2, if any, is gradually evened out as the intermediate transfer body 2 passes through the first transfer areas TP1 of the image carriers 1 (1*a* to 1*d*), so, image quality defects due to charge record are less likely to occur. Thus, instead of the cleaning electric field Ec, the holding electric field Eh is formed in the second transfer area TP2 to reduce the amount of waste toner.

Furthermore, in the image forming apparatus including the contacting/retracting mechanism 6, the image carrier 1 (in this exemplary embodiment, 1*a*) located on the most upstream side, in the moving direction of the intermediate transfer body 2, among the multiple image carriers 1 forms an image with a less visible color component toner (such as yellow toner or clear toner) than the other color component toners.

When the full contact mode is selected, if the image carrier 1 located on the most upstream side, in the moving direction of the intermediate transfer body 2, forms an image with a less visible color component toner, even if the intermediate transfer body 2 having a residual charge difference passes through the first transfer area TP1 of the image carrier 1 located on the most upstream side (for example, 1*a*), causing unevenness of an image due to the residual charge difference, the unevenness of the image is less noticeable than that in a case where a highly visible toner is used. Very little unevenness of an image due to a residual charge difference is observed in the image carriers located on the downstream side because the residual potential difference is gradually evened out as the intermediate transfer body 2 passes through the first transfer areas TP1.

Furthermore, in the image forming apparatus including the contacting/retracting mechanism 6, the image carrier 1 for forming a black toner image is located on the most downstream side, in the moving direction of the intermediate transfer body 2, and is in contact with the intermediate transfer body 2 to be used to form an image, in either image forming state in which one image carrier 1 is used or multiple image carriers 1 are used.

The image carrier 1 (in this exemplary embodiment, 1*d*) located on the most downstream side, in the moving direction of the intermediate transfer body 2, forms a black toner image.

In any image formation mode, i.e., a full-color mode, a single black mode, or a two-color mode including black, the image carrier 1 for forming black toner images (in this exemplary embodiment, 1*d*) is always used for the image-forming operation and is in contact with the intermediate transfer body 2.

For example, when the partial contact mode is selected, the charge record remaining in the intermediate transfer body 2 is reduced by the cleaning electric field Ec formed in the second transfer area TP2, before the intermediate transfer body 2 passes through the first transfer area TP1 of the image carrier 1*d* for forming black toner images. Thus, image quality defects due to charge record of the intermediate transfer body 2 do not occur. Furthermore, for example, when the single black mode is selected, the distance between the image carrier 1*d* located on the most downstream side and the second transfer area TP2 in the second transfer device 5 is smaller than that in other configurations. Thus, the time taken to form a black image is reduced.

Furthermore, the image forming apparatus includes an image-quality selecting device 11 that selects image-quality priority processing in which the priority is given to the quality of a transferred image. When the image-quality selecting device 11 selects the image-quality priority processing, the adjusting device 10 adjusts the electric field to be formed in the second transfer area TP2 to the cleaning electric field Ec, and when the image-quality selecting device 11 does not select the image-quality priority processing, the adjusting device 10 adjusts the electric field to be formed in the second transfer area TP2 to the holding electric field Eh, which is of opposite polarity to the second-transfer electric field E1.

The electric field adjusted by the adjusting device 10 is switched, between the image-quality priority mode, in which the image-quality priority processing is performed, and the mode in which the image-quality priority processing is not performed.

In this exemplary embodiment, when the image-quality priority mode is selected, a predetermined cleaning electric field Ec is selected to suppress image quality defects due to charge record remaining in the intermediate transfer body 2, and, when there is no need for that, the holding electric field Eh is selected instead of the cleaning electric field Ec to reduce the amount of waste toner transferred to the second transfer member 5*a*.

Furthermore, the image forming apparatus includes a speed selecting device 12 that selects, according to the type of the image to be formed, the speed of the image-forming processing performed on the image carriers 1 and the intermediate transfer body 2 during the image forming operation. When the speed selecting device 12 selects speed priority processing, in which an image-forming operation is performed at a speed higher than a predetermined speed, the adjusting device 10 adjusts the electric field to be formed in the second transfer area TP2 to the cleaning electric field Ec, and when the speed selecting device 12 does not select the speed priority processing, the adjusting device 10 adjusts the electric field to be formed in the second transfer area TP2 to the holding electric field Eh, which is of opposite polarity to the second-transfer electric field E2.

The electric field adjusted by the adjusting device 10 is switched, between the speed priority mode, in which the speed priority processing is performed, and the mode in which the speed priority processing is not performed.

In this exemplary embodiment, when the speed priority mode is selected, a predetermined cleaning electric field Ec is selected to suppress image quality defects due to charge record remaining in the intermediate transfer body 2, and, when there is no need for that, the holding electric field Eh is selected instead of the cleaning electric field Ec to reduce the amount of waste toner transferred to the second transfer member 5*a*.

In the image forming apparatus including the speed selecting device 12, the image forming apparatus includes a driving control device 13. When the speed selecting device 12 does not select the speed priority processing, and after the holding electric field Eh is applied to the second transfer area TP2 by the adjusting device 10, the driving control device 13 causes the intermediate transfer body 2 to make one free revolution, while applying a predetermined electric field to either the first transfer areas TP1 or the second transfer area TP2.

When the speed priority processing is not performed, the driving control device 13 causes the intermediate transfer body 2 to make one free revolution, while applying a predetermined electric field to either the first transfer areas TP1 or the second transfer area TP2. As a result, the charge record remaining in the intermediate transfer body 2 is gradually evened out while the intermediate transfer body 2 makes one free revolution.

Furthermore, the image forming apparatus includes a frequency prediction device 14 that predicts the frequency at which the image G transferred to the intermediate transfer body 2 passes through the second transfer area TP2 without the recording material 15 passing therethrough. When the frequency predicted by the frequency prediction device 14 is greater than or equal to a predetermined frequency, the adjusting device 10 adjusts the electric field to be formed in the second transfer area TP2 to the cleaning electric field Ec, and when the frequency predicted by the frequency prediction device 14 is less than the predetermined frequency, the adjusting device 10 adjusts the electric field to be formed in the second transfer area TP2 to the holding electric field Eh, which is of opposite polarity to the second-transfer electric field E2.

The frequency at which the image G on the intermediate transfer body 2 passes through the second transfer area TP2 without the recording material 15 passing therethrough, is predicted, and the electric field to be adjusted by the adjusting device 10 is switched according to the frequency.

In this exemplary embodiment, if the frequency is high, the charge record tends to remain in the intermediate transfer body 2, so, a predetermined cleaning electric field Ec is selected to suppress image quality defects due to charge record, and if the frequency is low, the charge record is less likely to remain in the intermediate transfer body 2, so, the holding electric field Eh is selected instead of the cleaning electric field Ec to reduce the amount of waste toner transferred to the second transfer member 5*a*.

Furthermore, when the intermediate transfer body 2 carrying no image G passes through the second transfer area TP2 without the recording material 15 passing therethrough, the adjusting device 10 adjusts the electric field to be formed in the second transfer area TP2 to the cleaning electric field Ec.

In general, when an area of the intermediate transfer body 2 carrying no image G passes through the second transfer area TP2 without the recording material 15 passing therethrough, the area receives the influence of the electric field. However, in this exemplary embodiment, because the area of the intermediate transfer body 2 carrying no image G receives the influence of the cleaning electric field Ec when passing through the second transfer area TP2, the charge record in this area is reduced.

Furthermore, the relationship $|B1-B3|>|B1-B2|$ is satisfied, where B1, B2, and B3 are voltages applied by the adjusting device 10 to form the second-transfer electric field E2, the cleaning electric field Ec, and the holding electric field Eh, respectively, in the second transfer area TP2.

When the toner used for the image-forming operation is negatively charged, the electric fields E2 and Ec are negative, and the electric field Eh is positive. Thus, the voltages B1 to B3 are values in the polarity of the corresponding electric fields. On the other hand, when the toner used for the image-forming operation is positively charged, the electric fields E2 and Ec are positive and the electric field Eh is negative. Thus, the voltages B1 to B3 are values in the polarity of the corresponding electric fields.

Furthermore, the intermediate transfer body 2 has a base member and a surface layer. The surface layer has higher surface resistivity than the base member. The surface layer having high surface resistivity provides improved capability of carrying images (toner) on the intermediate transfer body 2, and the base member having low surface resistivity suppresses discharge to the first transfer members 3*a*. Thus, the image quality is further improved.

Furthermore, in the adjusting device 10, the second transfer device 5 includes an electric-field forming device that forms the second-transfer electric field E2 in the second transfer area TP2, and the adjusting device 10 serves a dual function as the electric-field forming device. The adjusting device 10 serves a dual function as the electric-field forming device of the second transfer device 5, contributing to a reduction in the number of components, compared with a case where such a device is separately provided.

Next, the present invention will be described in more detail according to various exemplary embodiments shown in the attached drawings.

First Exemplary Embodiment

Overall Configuration of Image Forming Apparatus

Figure 3:
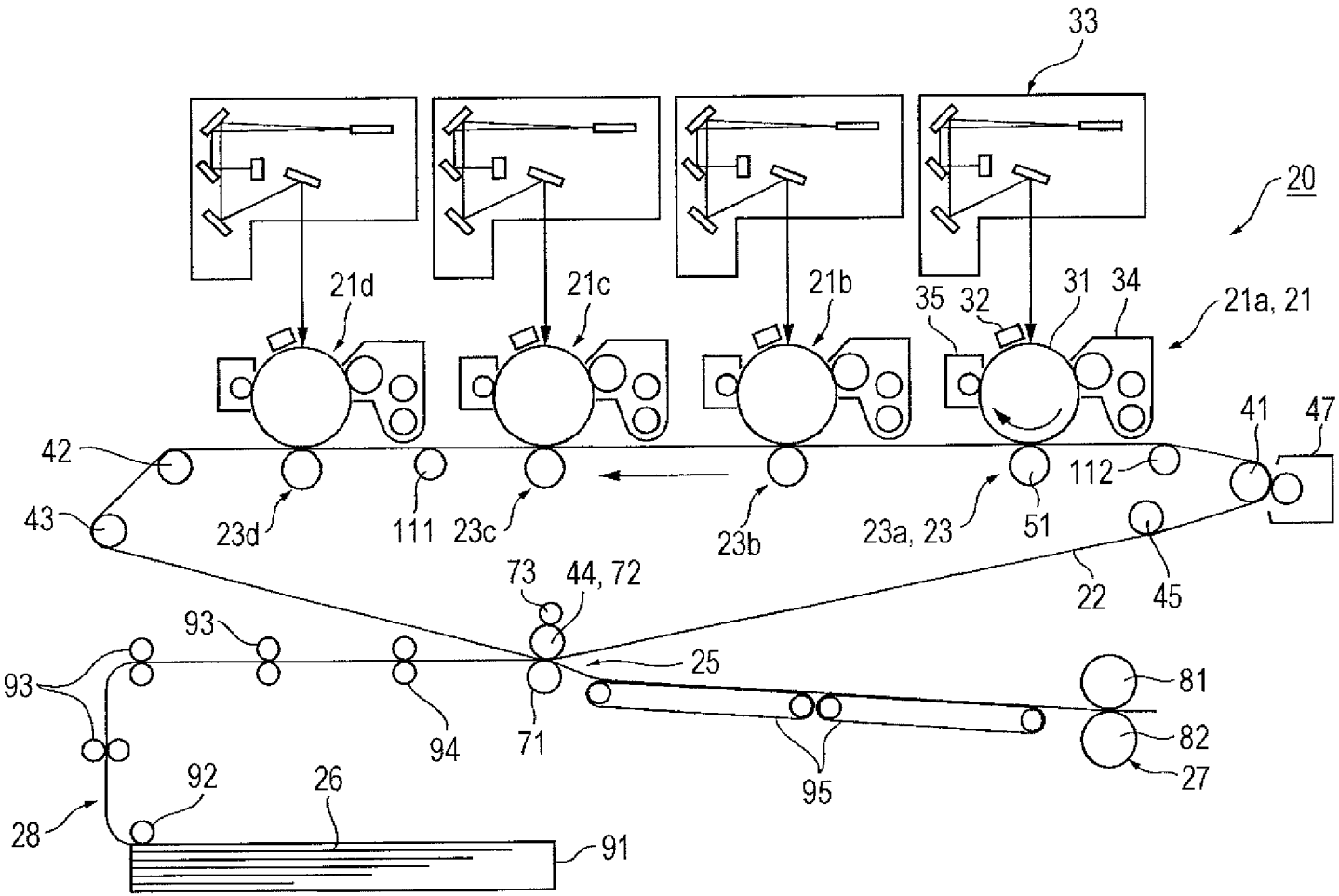
FIG. 3 illustrates the overall configuration of an image forming apparatus according to a first exemplary embodiment.

FIG. 3 illustrates the overall configuration of an image forming apparatus according to the first exemplary embodiment.

In FIG. 3, an image forming apparatus 20 is a tandem image forming apparatus of an intermediate transfer type and includes multiple color-component image forming units 21*a* to 21*d* (collectively, 21, and corresponding to yellow (Y), magenta (M), cyan (C), and black (K), in this exemplary embodiment) that are arranged in a substantially horizontal transverse direction. A belt-shaped intermediate transfer body 22, which is configured to revolve, is provided so as to face the image forming units 21. First transfer devices 23*a* to 23*d* (collectively, 23) are provided adjacent to the inner surface of the intermediate transfer body 22, at positions corresponding to the image forming units 21. The first transfer devices 23 transfer images formed with the color component toners (hereinbelow, color component toner images) in the image forming units 21 to the intermediate transfer body 22 (hereinbelow, first transfer). A second transfer device 25 that transfers the color component images, transferred to the intermediate transfer body 22, to a sheet 26, serving as a recording material, (hereinbelow, second transfer or simultaneous transfer) is provided at a portion of the intermediate transfer body 22 located on the downstream side of the image forming unit 21 on the most downstream side, in the moving direction of the intermediate transfer body 22 (in this exemplary embodiment, 21*d*).

The image forming apparatus 20 according to this exemplary embodiment further includes a fixing device 27 that fixes the image simultaneously transferred onto the sheet 26 at the second transfer device 25 to the sheet 26, and a sheet transport system 28 that transports the sheet 26 to a position where the second transfer device 25 performs the second transfer or to a position where the fixing device 27 performs fixing.

In this exemplary embodiment, each of the image forming units 21*a* to 21*d* includes a drum-shaped photosensitive member 31; a charger 32, such as a corotron, that charges the photosensitive member 31; an exposure device 33, such as a laser scanning device, that forms an electrostatic latent image on the charged photosensitive member 31; a developing device 34 that develops the electrostatic latent image formed on the photosensitive member 31 with color component toner; and a cleaning device 35 that removes the residual toner on the photosensitive member 31. The charger 32, the exposure device 33, the developing device, and the cleaning device 35 are arranged so as to surround the photosensitive member 31.

The intermediate transfer body 22 is stretched over multiple (in this exemplary embodiment, five) stretching rollers 41 to 45. The stretching roller 41 is used as a driving roller driven by a driving motor (not shown), and the stretching rollers 42 to 45 are used as driven rollers. The stretching roller 43 is used as a correcting roller that prevents the intermediate transfer body 22 from moving in a width direction, which substantially crosses the moving direction of the intermediate transfer body 22, and the stretching roller 44 is used as an opposing roller disposed opposite the second transfer device 25. Furthermore, a cleaning device 47 that removes residual toner on the intermediate transfer body 22 after the second transfer is provided adjacent to the outer surface of the intermediate transfer body 22, at a position facing the stretching roller 41.

In this exemplary embodiment, the intermediate transfer body 22 has a base member and a surface layer, and the surface layer has higher volume resistivity than the base member. The volume resistivity of the surface layer is 11 (log Ω·cm) or more, and the volume resistivity of the base member is 10 (log Ω·cm) or less.

The intermediate transfer body 22 having such a volume resistivity is suitable because, due to its high surface resistivity, it has good capability of carrying toner images and, thus, forms high-quality images. However, because the volume resistivity of the entire intermediate transfer body 22 is also high, the charge record remaining in the intermediate transfer body 22 is less likely to disappear, resulting in image quality defects due to charge record.

Furthermore, in this exemplary embodiment, the first transfer devices 23 include first transfer rollers 51 that are in contact with the inner surface of the intermediate transfer body 22, at positions corresponding to the photosensitive members 31. By urging the first transfer rollers 51 against the photosensitive members 31 with a predetermined load, contact areas (nip areas), serving as the first transfer areas TP1, are formed between the photosensitive members 31 and the intermediate transfer body 22. Furthermore, by supplying a predetermined first transfer current to the first transfer rollers 51, the first-transfer electric fields E1 are formed in the first transfer areas TP1, by which the color component toner images on the photosensitive members 31 are transferred to the intermediate transfer body 22. In this exemplary embodiment, because the base member of the intermediate transfer body 22 has a low volume resistivity, the intermediate transfer body 22 does not unnecessarily discharge, even if it is in contact with the first transfer rollers 51.

Figure 4:
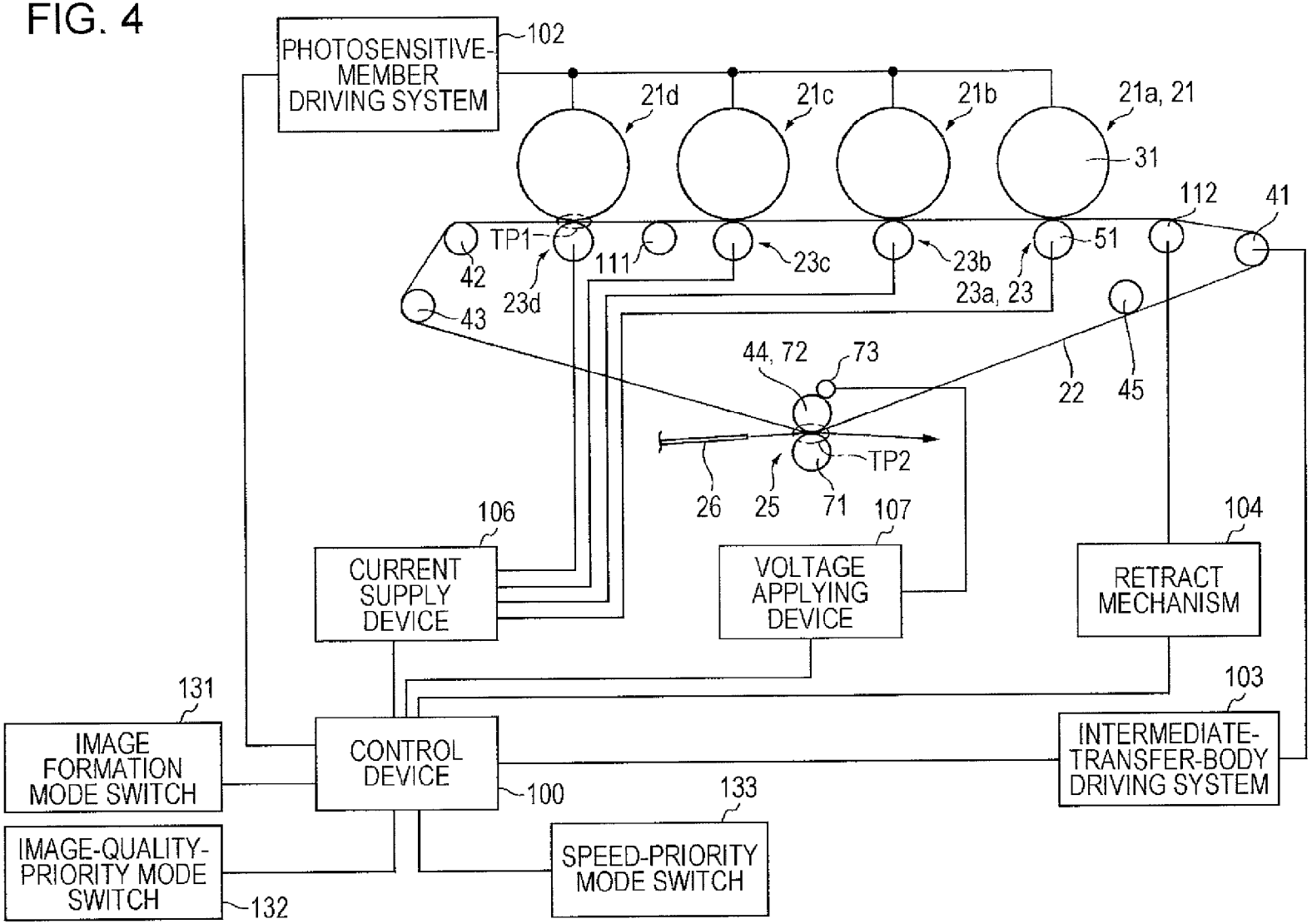
FIG. 4 illustrates a drive and control system of the image forming apparatus according to the first exemplary embodiment.
Figure 7:
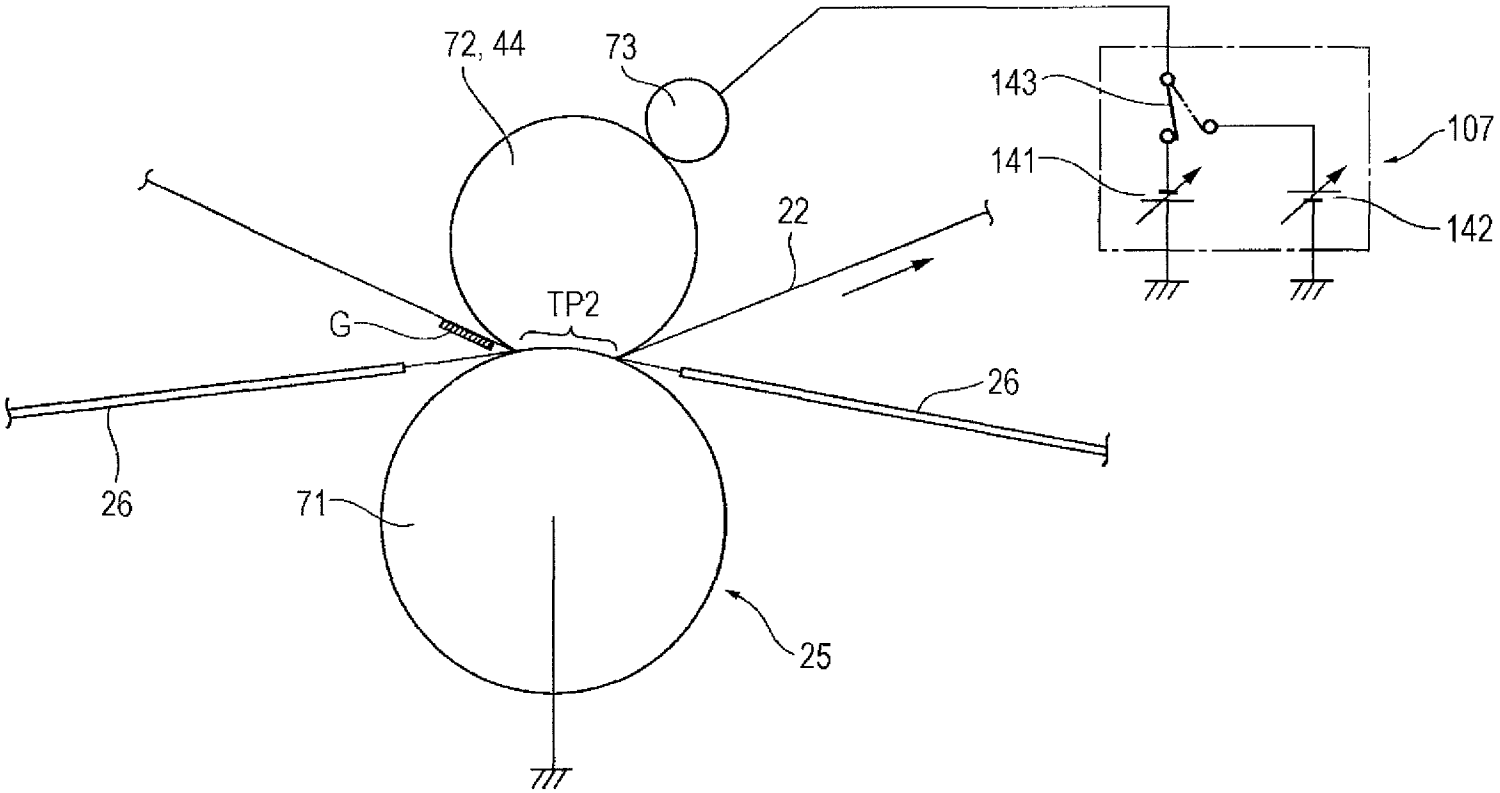
FIG. 7 illustrates an example of a voltage applying device of a second transfer device used in the first exemplary embodiment.

Furthermore, as shown in FIGS. 3, 4, and 7, the second transfer device 25 includes a second transfer roller 71 that is in contact with the outer surface of the intermediate transfer body 22, at a position corresponding to the stretching roller 44, thereby forming a contact area (nip area), serving as the second transfer area TP2, between the second transfer roller 71 and the intermediate transfer body 22. A power-supply roller 73 is in contact with the surface of the stretching roller 44, which serves as the opposing roller 72 facing the second transfer roller 71. By applying a predetermined second transfer voltage to the power-supply roller 73, and by grounding the second transfer roller 71, the second-transfer electric field E2 is formed in the second transfer area TP2, thereby transferring the color component toner images on the intermediate transfer body 22 to the sheet 26.

The fixing device 27 includes a heat-fixing roller 81 that has, for example, an internal heat source, and a press-fixing roller 82 that is pressed against the heat-fixing roller 81 and is rotated by the rotation of the heat-fixing roller 81. The unfixed image on the sheet 26 is heated and pressed between the fixing rollers 81 and 82, and thus, fixed.

The sheet transport system 28 feeds the sheet 26 stored in a sheet container 91 to a sheet transport path by a feed roller 92. An appropriate number of transport rollers 93 are provided in the sheet transport path. Positioning rollers 94, which supply the sheet 26 to the second transfer area TP2 at a predetermined time after positioning the sheet 26, are provided in the sheet transport path immediately before the second transfer area TP2. Furthermore, transport belts 95 that transport the sheet 26 to the fixing device 27 are provided downstream of the second transfer area TP2 in the sheet transport path.

The sheet 26 having passed through the fixing device 27 is output onto, for example, a sheet output container (not shown) via an output roller (not shown).

Drive and Control System of the Image Forming Apparatus

FIG. 4 illustrates a drive and control system for the image forming apparatus according to the first exemplary embodiment.

In FIG. 4, a control device 100 controls image forming operation performed by the image forming apparatus. The control device 100 is formed of a microcomputer including a central processing unit (CPU), a read-only memory (ROM), a random-access memory (RAM), and input/output interfaces. The control device 100 obtains, through the input/output interfaces, input signals from a start switch (not shown), an image formation mode switch 131 for selecting an image formation mode, an image-quality-priority mode switch 132 for selecting an image-quality priority mode in which priority is given to the image quality, and a speed-priority mode switch 133 for selecting a speed priority mode in which priority is given to the image-forming processing speed. The control device 100 executes, by the CPU, an anti-ghost control processing program (see FIGS. 9 and 12 to 14) stored in the ROM, generates control signals for the drive control targets, and transmits the control signals for the drive control targets.

In FIG. 4, the drive control targets include a photosensitive-member driving system 102 that drives the photosensitive members 31 of the image forming units 21*a* to 21*d*; an intermediate-transfer-body driving system 103 that causes the intermediate transfer body 22 to revolve by rotating, for example, the stretching roller 41 serving as the driving roller; a retract mechanism 104 that brings the intermediate transfer body 22 toward or away from the photosensitive members 31 of the image forming units 21*a* to 21*d*; a current supply device 106 that supplies a first transfer current to the first transfer rollers 51 of the first transfer devices 23 in the image forming units 21; and a voltage applying device 107 that applies various voltages, including the second transfer voltage, to the power-supply roller 73 in the second transfer device 25.

Retract Mechanism

Figure 5A:
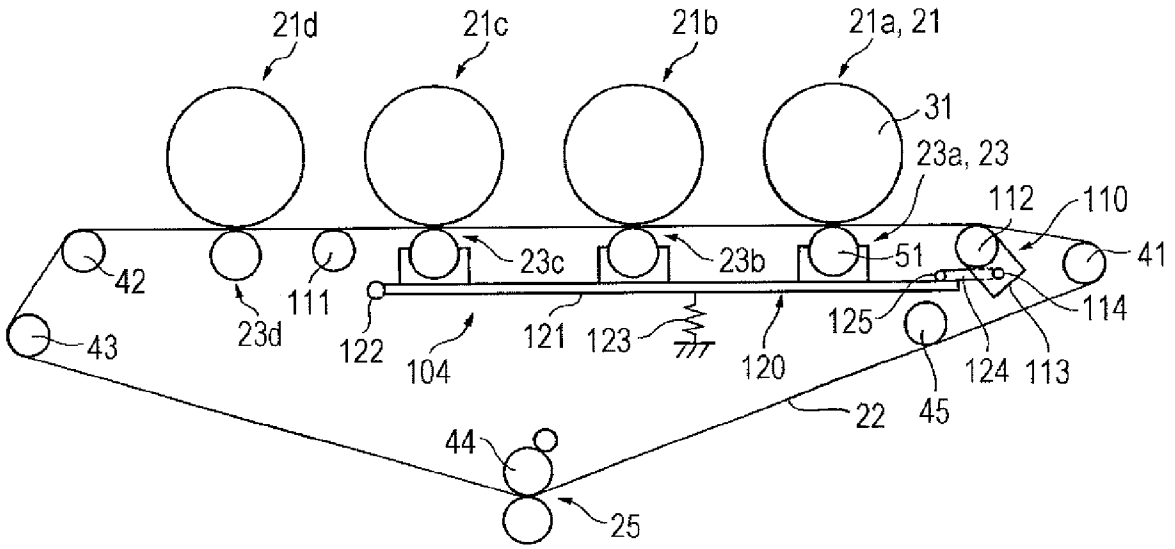
FIG. 5A illustrates a retract mechanism of an intermediate transfer body used in the first exemplary embodiment.
Figure 5B:
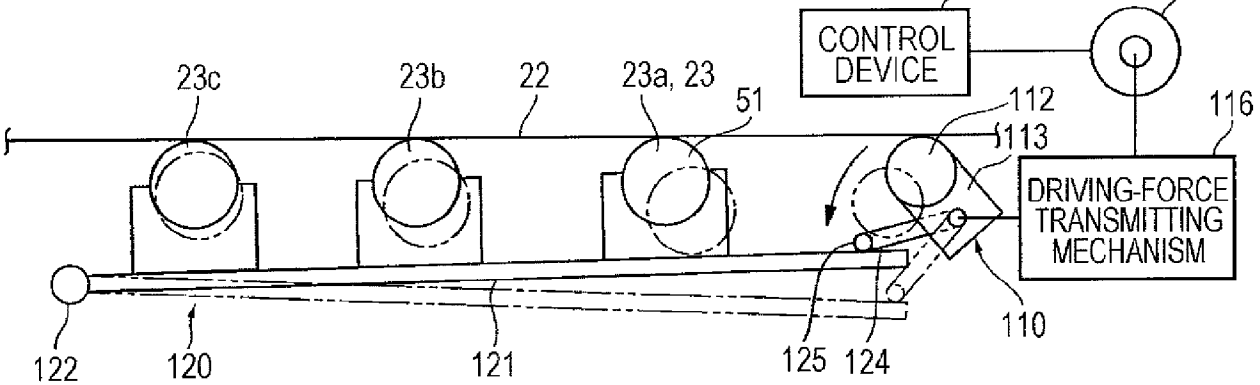
FIG. 5B illustrates the movement of the retract mechanism.

FIGS. 5A and 5B illustrates the details of the retract mechanism 104 used in this exemplary embodiment.

In FIGS. 5A and B, the retract mechanism 104 brings the intermediate transfer body 22 toward or away from the photosensitive members 31 of the image forming units 21*a* to 21*c* other than the image forming unit 21*d* located on the most downstream side, in the moving direction of the intermediate transfer body 22. In this exemplary embodiment, when the intermediate transfer body 22 is retracted from the photosensitive members 31 of the image forming units 21*a* to 21*c*, the first transfer rollers 51 of the first transfer devices 23 corresponding to the image forming units 21*a* to 21*c* are retracted to positions where they are not in contact with the intermediate transfer body 22.

The retract mechanism 104 includes an intermediate-transfer-body contacting/retracting mechanism 110 that brings the intermediate transfer body 22 toward or away from the photosensitive members 31 of the image forming units 21 (in this exemplary embodiment, the image forming units 21*a* to 21*c*), and a cooperative mechanism 120 that moves in cooperation with the intermediate-transfer-body contacting/retracting mechanism 110 to bring the first transfer devices 23 (in this exemplary embodiment, the first transfer devices 23*a* to 23*c*) corresponding to the image forming units 21 (21*a* to 21*c*) toward or away from the intermediate transfer body 22.

The intermediate-transfer-body contacting/retracting mechanism 110 includes a fixed positioning roller 111 and a movable positioning roller 112, which serve to restrict the position of the intermediate transfer body 22. The fixed positioning roller 111 is located at a position between the image forming units 21*c* and 21*d* and adjacent to the inner surface of the intermediate transfer body 22. The movable positioning roller 112 is located at a position upstream of the image forming unit 21*a*, which is located on the most upstream side, in the moving direction of the intermediate transfer body 22, and adjacent to the inner surface of the intermediate transfer body 22. This movable positioning roller 112 is supported by a pivot stage 113 that pivots about a pivot fulcrum 114.

As shown in FIG. 5B, a driving system for the intermediate-transfer-body contacting/retracting mechanism 110 includes a driving motor 115 that starts to rotate based on a control signal from the control device 100. The driving force of the driving motor 115 is transmitted to the pivot fulcrum 114 of the pivot stage 113 through a driving-force transmitting mechanism 116, such as gears and a belt.

The cooperative mechanism 120 includes a pivot plate 121 that pivots about a pivot fulcrum 122 inside the intermediate transfer body 22. The pivot fulcrum 122 is located at an intermediate position between the image forming units 21*c* and 21*d*. The first transfer devices 23*a* to 23*c* are provided in a fixed manner on the pivot plate 121. The pivot plate 121 is urged toward the intermediate transfer body 22 by an urging coil 123. Furthermore, a rotation member 124 that rotates in association with the pivot of the pivot stage 113 is provided at the pivot fulcrum 114 of the pivot stage 113 of the intermediate-transfer-body contacting/retracting mechanism 110, and an engaging piece 125 is provided away from the pivot fulcrum 114 of the rotation member 124. The engaging piece 125 is engaged with a free end of the pivot plate 121.

In this retract mechanism 104, for example, in the full contact mode, in which the intermediate transfer body 22 is in contact with the photosensitive members 31 of all the image forming units 21*a* to 21*d*, as shown in FIG. 5B, the movable positioning roller 112 of the intermediate-transfer-body contacting/retracting mechanism 110 is advanced to an advanced position indicated by a solid line.

Figure 6A:
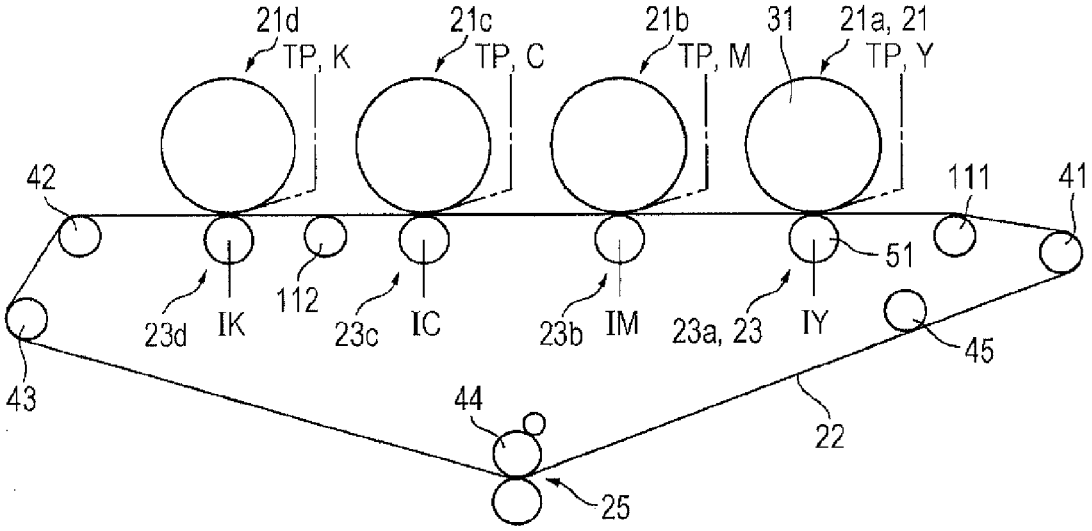
FIGS. 6A and 6B illustrate moving states, in an FC mode and in a single K mode, respectively, of the image forming apparatus according to the first exemplary embodiment.

At this time, a portion of the intermediate transfer body 22 corresponding to the image forming units 21*a* to 21*c* is positioned by the fixed positioning roller 111 and the movable positioning roller 112, as shown in FIG. 6A, such that the photosensitive members 31 of the image forming units 21 (21*a* to 21*c*), as well as the first transfer rollers 51 of the first transfer devices 23 (23*a* to 23*c*) corresponding to the image forming units 21 (21*a* to 21*c*), are in contact with the intermediate transfer body 22.

On the other hand, in the partial contact mode in which the intermediate transfer body 22 is not in contact with the photosensitive members 31 of the image forming units 21 (21*a* to 21*c*) except for the image forming unit 21*d* located on the most downstream side, as shown in FIG. 5B, the movable positioning roller 112 of the intermediate-transfer-body contacting/retracting mechanism 110 is retracted to a retract position indicated by a two-dot chain line.

Figure 6B:
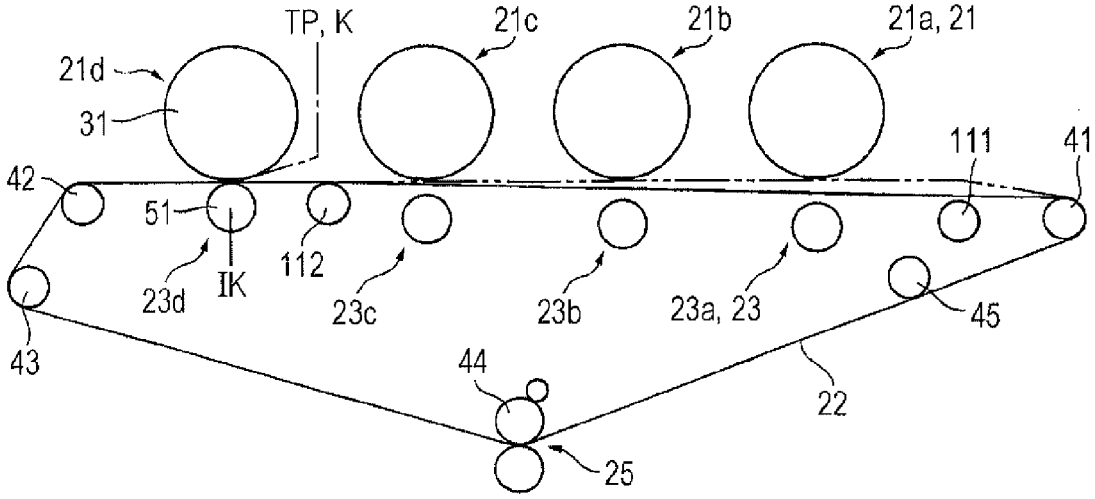

At this time, as shown in FIG. 6B, the portion of the intermediate transfer body 22 corresponding to the image forming units 21 (21*a* to 21*c*) is positioned by the fixed positioning roller 111 and the stretching roller 41, and the photosensitive members 31 of the image forming units 21 (21*a* to 21*c*) are not in contact with the intermediate transfer body 22, and the intermediate transfer body 22 is not in contact with the movable positioning roller 112 retracted to the retract position. Furthermore, as shown in FIG. 5B, as a result of the movable positioning roller 112 being retracted to the retract position, the rotation member 124 of the cooperative mechanism 120 moves to the position shown by the two-dot chain line, causing the pivot plate 121 to pivot downward about the pivot fulcrum 122 via the engaging piece 125.

Thus, the first transfer devices 23 (in this exemplary embodiment, the first transfer devices 23*a* to 23*c*) provided on the pivot plate 121 are not in contact with the intermediate transfer body 22.

Voltage Applying Device

FIG. 7 illustrates the voltage applying device 107 used in this exemplary embodiment.

In FIG. 7, the voltage applying device 107 includes a first variable power supply 141 capable of controlling a negative voltage, a second variable power supply 142 capable of controlling a positive voltage, a switch 143 that switches between the first variable power supply 141 and the second variable power supply 142. The voltage applying device 107 determines the voltage for forming an electric field to be applied to the second transfer area TP2 according to the control signal from the control device 100 and applies the thus-determined voltage to the opposing roller 72 (44) via the power-supply roller 73.

In this exemplary embodiment, electric fields to be applied to the second transfer area TP2 are as follows:

1. Second-Transfer Electric Field

The second-transfer electric field E2 is used to transfer (second transfer) the color component images, which have been transferred (first transfer) from the photosensitive members 31 of the image forming units 21*a* to 21*d* to the intermediate transfer body 22, to the sheet 26. The second-transfer electric field E2 acts in such a direction that the negative toner on the intermediate transfer body 22 is electrostatically transferred to the sheet 26.

In order to form this second-transfer electric field E2, a negative voltage (bias) sufficient to move the toner on the intermediate transfer body 22 to the sheet 26 is applied to the opposing roller 72 via the power-supply roller 73.

Figure 8A:
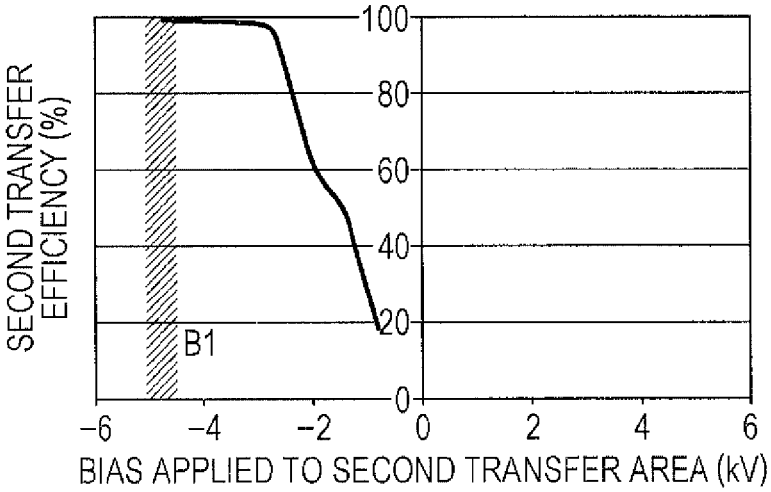
FIG. 8A illustrates a bias B1 applied to a second transfer area to form a second-transfer electric field E2.

In this exemplary embodiment, as shown in, for example, FIG. 8A, by increasing the absolute value of the negative voltage (bias) applied to the second transfer area TP2, the second transfer efficiency (i.e., the proportion of the amount of the toner image moved to the sheet in the amount of the toner image on the intermediate transfer body) reaches nearly 100% (for example, 98% or more). The range of the voltage (bias) with which the second transfer efficiency is nearly 100% is regarded as the allowable range for the second-transfer electric field E2, and a voltage (bias) within the allowable range is selected as the second transfer voltage (bias) B1.

2. Cleaning Electric Field

The cleaning electric field Ec reduces the charge record (i.e., the difference in amount of charge between the image portion and the non-image portion) remaining in the intermediate transfer body 22. The cleaning electric field Ec is of the same polarity as and a lower intensity than the second-transfer electric field E2.

Figure 8B:
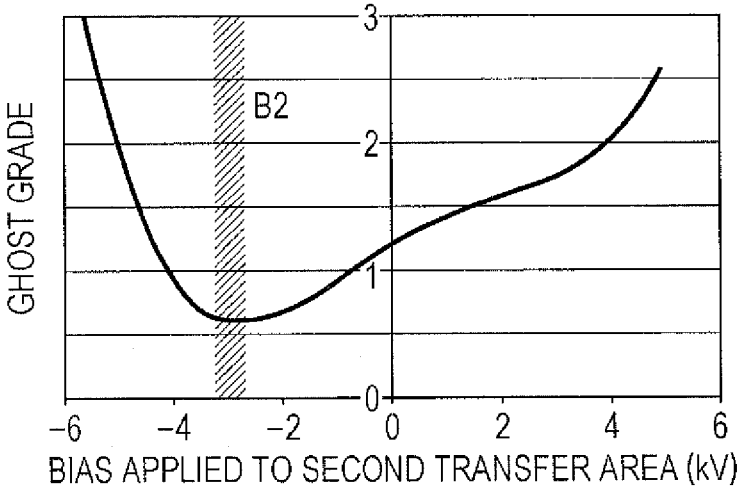
FIG. 8B illustrates a bias B2 applied to the second transfer area to form a cleaning electric field Ec.

In this exemplary embodiment, as shown in, for example, FIG. 8B, the relationship between the ghost grade and the voltage (bias) to be applied to the second transfer area TP2 is observed on the basis of, for example, a ghost evaluation method, which will be described in the following exemplary embodiment. The result shows that the ghost grade shows a peak, or the best result, near a voltage (bias) B2, which is lower than the second transfer bias B1, and the ghost grade gradually gets worse as the second transfer bias is farther from the value at the peak. Accordingly, in this exemplary embodiment, the voltage (bias) 32 is selected as the cleaning voltage (bias) for forming the cleaning electric field Ec.

In this exemplary embodiment, although a range in which the ghost grade is about 0.5 is used as the range for selecting the cleaning voltage (bias) B2, this range may be expanded to some extent, depending on the acceptable level of the ghost grade.

3. Holding Electric Field

The holding electric field Eh is needed when an image on the intermediate transfer body 22 passes through the second transfer area TP2 without the sheet 26 passing therethrough. The holding electric field Eh makes the image stay on the intermediate transfer body 22 without moving to the second transfer roller 71.

Figure 8C:
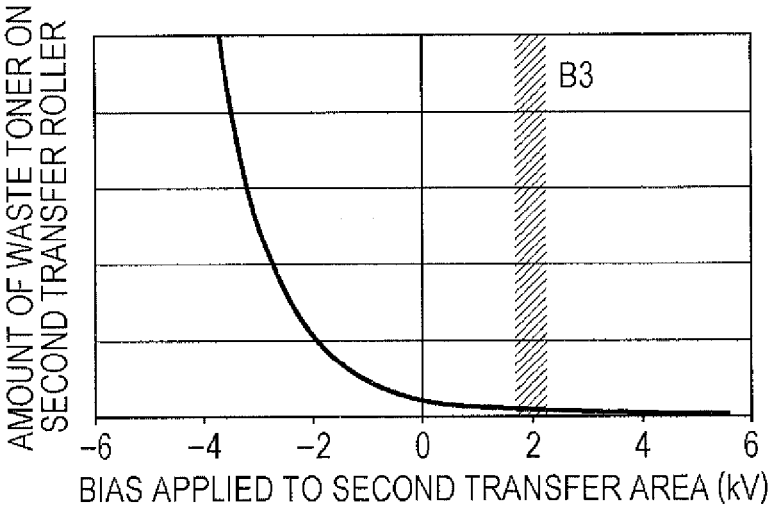
FIG. 8*c* illustrates a bias B3 applied to the second transfer area to form a holding electric field Eh.

In this exemplary embodiment, as shown in FIG. 8C, the relationship between the amount of toner deposited on the second transfer roller 71 (in this exemplary embodiment, the amount of waste toner) and the voltage (bias) to be applied to the second transfer area TP2 is observed. When the voltage (bias) of the same polarity as the second transfer bias B1 is applied to the second transfer area TP2, the amount of waste toner decreases with the drop of the voltage. When the voltage comes to have opposite polarity to the second transfer bias B1, the amount of waste toner is further reduced, and at a predetermined voltage (bias) B3, the amount of waste toner is substantially 0. Accordingly, in this exemplary embodiment, the voltage (bias) B3 is selected as a holding voltage (bias) for forming the holding electric field Eh.

Operation of Image Forming Apparatus

Next, the operation of the image forming apparatus according to this exemplary embodiment will be described.

Anti-Ghost Control Processing 1

Figure 9:
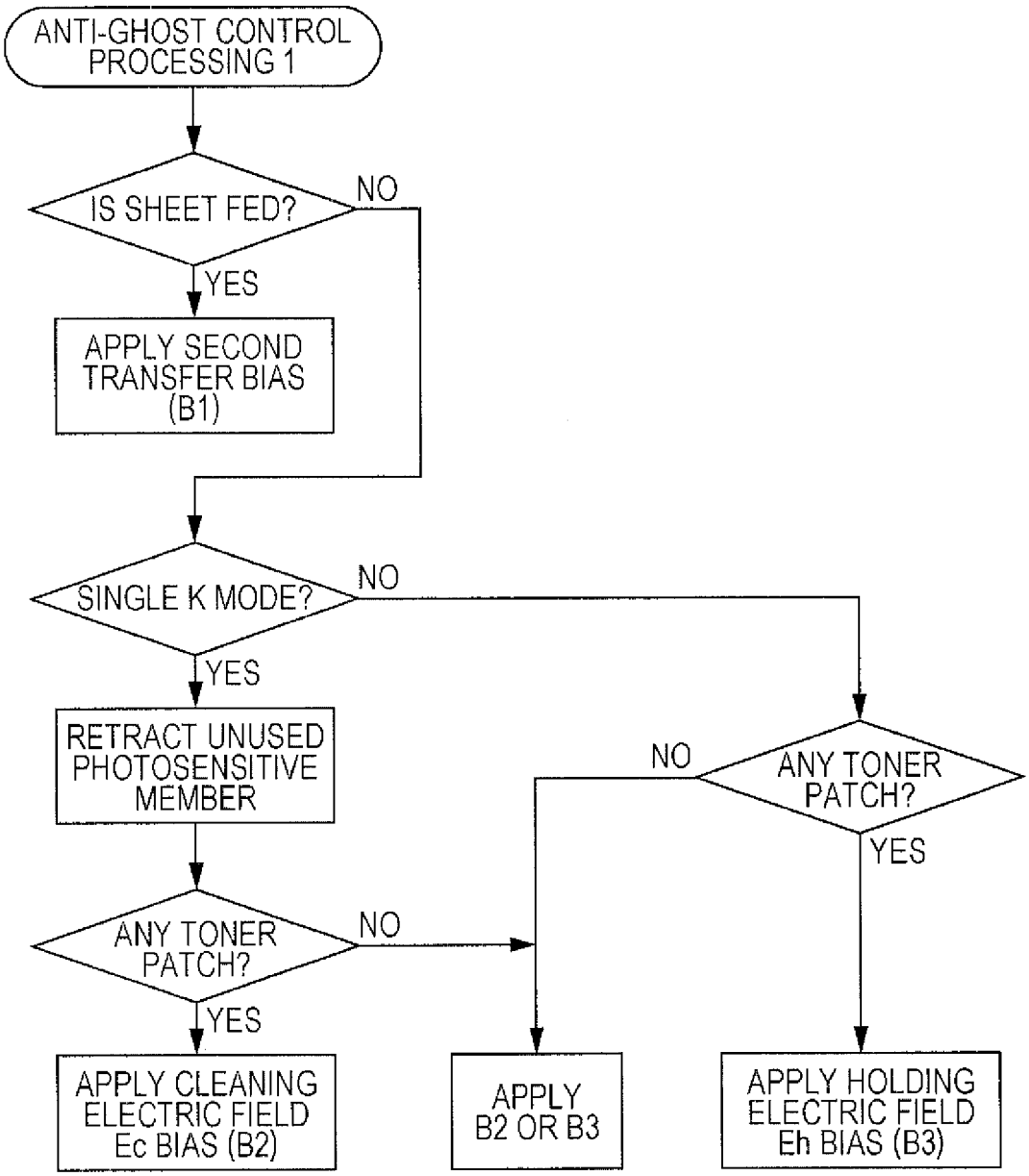
FIG. 9 is a flowchart of anti-ghost control processing 1 performed in the first exemplary embodiment.

FIG. 9 is a flowchart showing anti-ghost control processing 1 performed by the image forming apparatus according to this exemplary embodiment.

As shown in FIG. 4, a user may select the image formation mode from an FC mode (full-color mode) and a single K mode (single color K mode) by operating the image formation mode switch 131.

When the user selects the FC mode, the control device 100 determines that the image formation mode is the FC mode and selects an FC mode process. In this state, as shown in FIG. 6A, the control device 100 selects the full contact mode for the retract mechanism 104.

Then, the control device 100 adjusts first and second transfer conditions according to the FC mode.

On the other hand, when the user selects the single K mode, the control device 100 determines that the image formation mode is the single K mode and selects a single K mode process. In this state, as shown in FIG. 6B, the control device 100 selects the partial contact mode for the retract mechanism 104 and adjusts the first and second transfer conditions according to the single K mode.

Image Transfer to Sheet

Figure 10A:
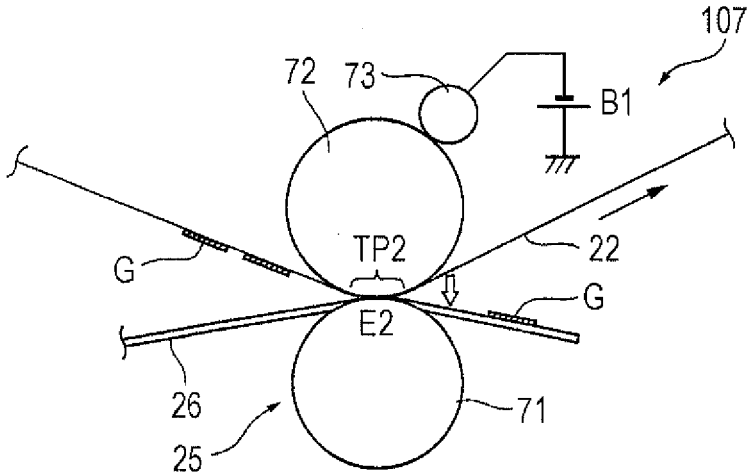
FIG. 10A illustrates the movement of the second transfer device when a sheet is fed to the second transfer area of the image forming apparatus according to the first exemplary embodiment.
Figure 10B:
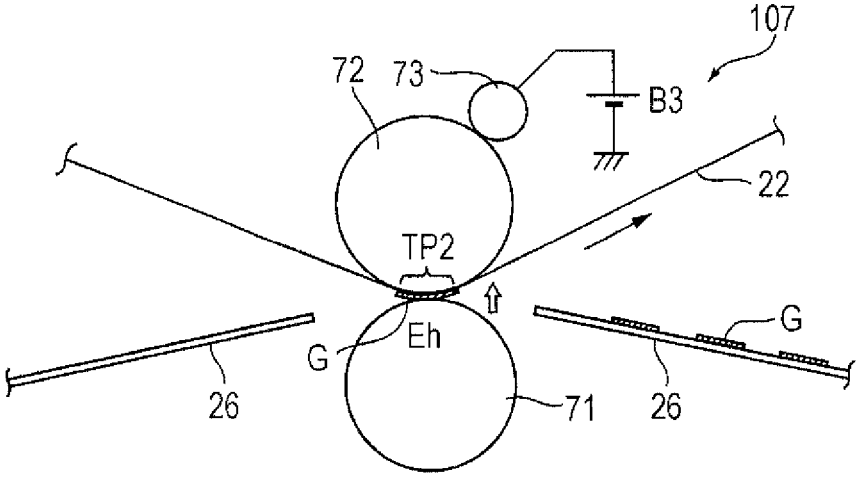
FIG. 10B illustrates the movement of the second transfer device, in the FC mode, when a sheet is not fed to the second transfer area and when a toner patch for process control is made to pass therethrough.

As shown in FIG. 9, when the sheet 26 passes through the second transfer area TP2 (when the sheet 26 is fed), the second transfer bias B1 is applied to the second transfer area TP2, forming the second-transfer electric field E2 in the second transfer area TP2. As a result, as shown in FIG. 10A, the image G on the intermediate transfer body 22 is transferred to the sheet 26 and is fixed thereto in the fixing device 27.

When Toner Patch Passes

To control the image density and the image position, a rectangular toner patch G, serving as a process control image, is sometimes formed in an inter-image area S, in which the sheet 26 does not pass through the second transfer area TP2 (i.e., an area between the image areas of the sheets 26).

This toner patch G passes through the second transfer area TP2 without the sheet 26 passing therethrough. In this exemplary embodiment, the electric field to be formed in the second transfer area TP2 is changed according to the image formation mode (FC mode or single K mode).

In this exemplary embodiment, as shown in FIG. 103, when the FC mode is selected, the holding voltage (bias) B3 is applied to the second transfer area TP2, forming the holding electric field Eh in the second transfer area TP2. Thus, the toner patch G on the intermediate transfer body 22 passes through the second transfer area TP2 without moving to the second transfer roller 71 and becoming waste toner, and is cleaned by the cleaning device 47. The charge record remaining in the intermediate transfer body 22 is gradually reduced as it passes through the first transfer areas TP1 of the photosensitive members 31 in the image forming units 21 corresponding to the respective color components.

Figure 10C:
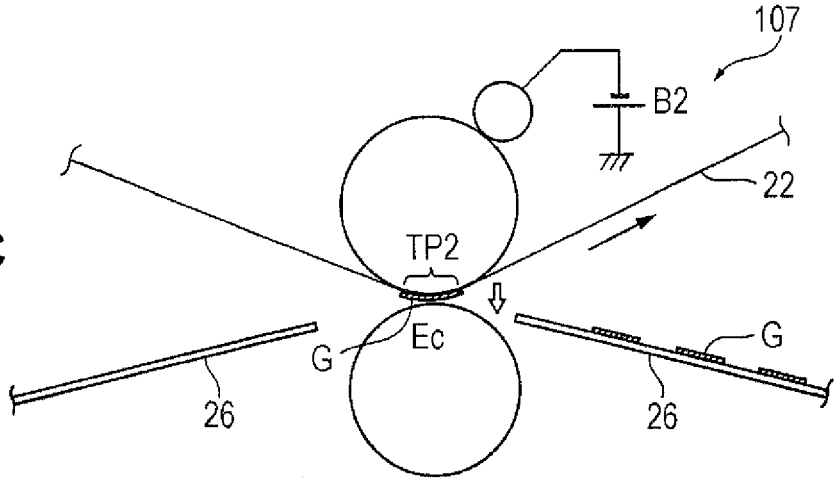
FIG. 10C illustrates the movement of the second transfer device, in the single K mode, when a sheet is not fed to the second transfer area and when a toner patch for process control is made to pass therethrough.

On the other hand, as shown in FIG. 10C, in the single K mode, the cleaning voltage (bias) B2 is applied to the second transfer area TP2, forming the cleaning electric field Eh in the second transfer area TP2. Thus, the toner patch G on the intermediate transfer body 22 is subjected to the cleaning electric field Ec when it passes through the second transfer area TP2.

Figure 11:
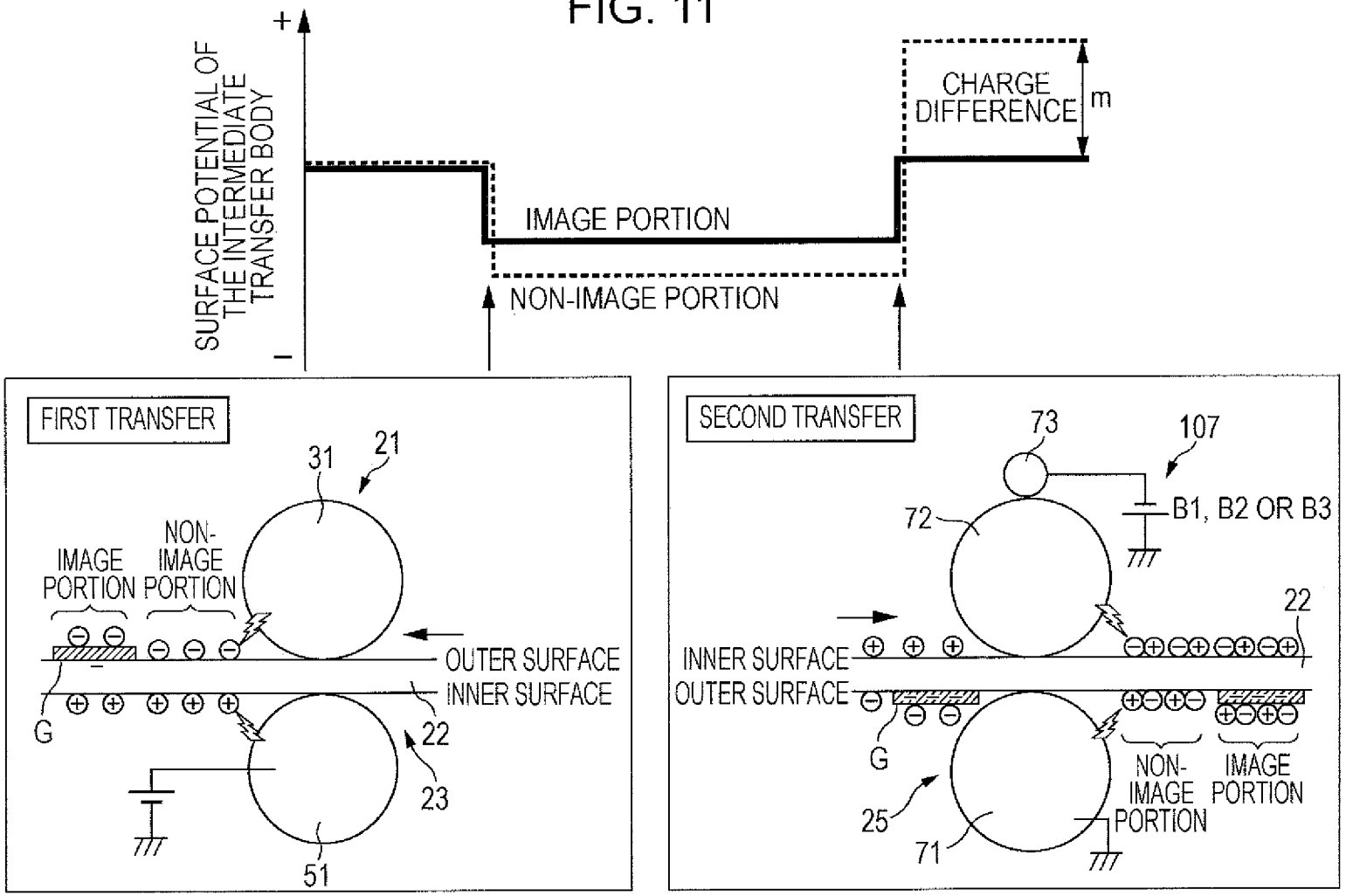
FIG. 11 is a schematic diagram illustrating changes in the surface potential, in a first transfer area and the second transfer area, of the intermediate transfer body of the image forming apparatus according to the first exemplary embodiment.

At this time, as shown in FIG. 11, the intermediate transfer body 22 is charged by the first-transfer electric fields E1 in the first transfer areas TP1 and is charged by the cleaning electric field Ec in the second transfer area TP2. When, for example, the second-transfer electric field E2 is formed in the second transfer area TP2, the toner patch G on the intermediate transfer body 22 having passed through the second transfer area TP2 has relatively large charge record m, which corresponds to the difference in amount of charge between the image portion and the non-image portion. On the other hand, when the cleaning electric field Ec is formed in the second transfer area TP2 instead of the second-transfer electric field E2, the charge record m shown in FIG. 11 is reduced. Hence, when the intermediate transfer body 22 having passed through the second transfer area TP2 passes through the first transfer area TP1 of the photosensitive member 31 of the image forming unit 21 (21*d*) used for the subsequent image-forming job (for example, in the single K mode), the charge record m remaining in the intermediate transfer body 22 is sufficiently low. Accordingly, image quality defects due to charge record do not occur.

In this exemplary embodiment, either in the FC mode or in the single K mode, when the intermediate transfer body 22 carrying no image passes through the second transfer area TP2 without the sheet 26 passing therethrough, the cleaning electric field Ec or the holding electric field Eh is formed in the second transfer area TP2. However, an appropriate method may be selected.

Anti-Ghost Control Processing 2

In this exemplary embodiment, the electric field to be formed in the second transfer area TP2 is changed according to whether or not the image-quality priority mode is selected.

As shown in FIG. 4, when the user turns on the image-quality-priority mode switch 132, the control device 100 determines that the image-quality priority mode is selected, and when the image-quality-priority mode switch 132 stays off, the control device 100 determines that the image-quality priority mode is not selected.

Image Transfer to Sheet

Figure 12:
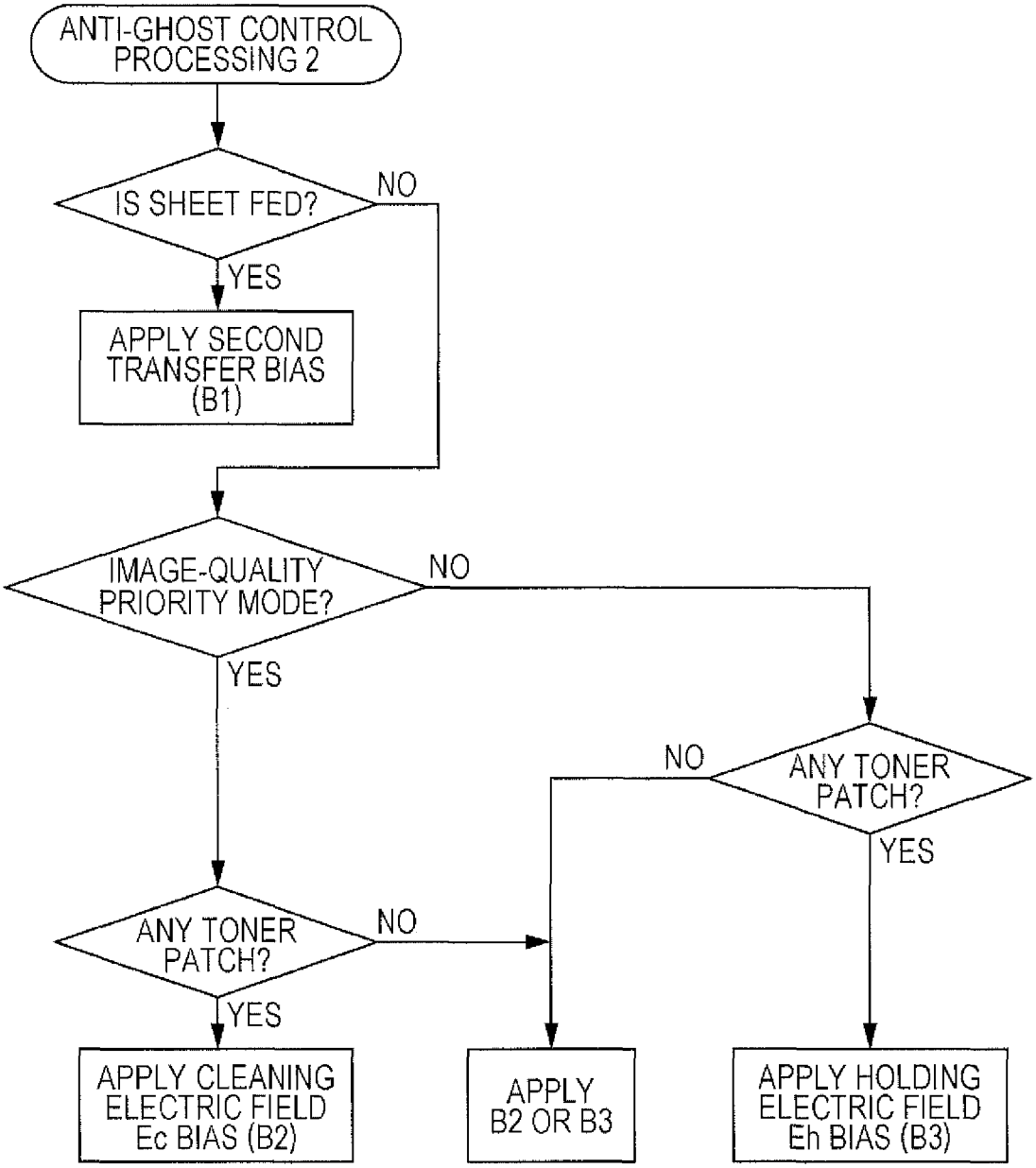
FIG. 12 is a flowchart of anti-ghost control processing 2 performed in the first exemplary embodiment.

As shown in FIG. 12, when the sheet 26 passes through the second transfer area TP2 (when the sheet 26 is fed), the second transfer bias B1 is applied to the second transfer area TP2, forming the second-transfer electric field E2 in the second transfer area TP2. As shown in FIG. 10A, the image G on the intermediate transfer body 22 is transferred to the sheet 26 and is fixed thereto in the fixing device 27.

When Toner Patch Passes

In this exemplary embodiment, the toner patch G, serving as a process control image, may pass through the second transfer area TP2 without the sheet 26 passing therethrough. When the image-quality priority mode is selected, as shown in FIG. 12, the cleaning bias B2 is applied to the second transfer area TP2, forming the cleaning electric field Ec. Hence, in the image-quality priority mode, when the toner patch G passes through the second transfer area TP2, the charge record is reduced, whereby image quality defects due to charge record are avoided.

On the other hand, when the image-quality priority mode is not selected, as shown in FIG. 12, the holding bias 33 is applied to the second transfer area TP2, forming the holding electric field Eh. Thus, when the image-quality priority mode is not selected, image quality defects due to charge record may be observed to some extent. However, due to the effect of the holding electric field Eh, the risk of the waste toner moving to the second transfer roller 71 is reduced.

In this exemplary embodiment, when the intermediate transfer body 22 carrying no image passes through the second transfer area TP2 without the sheet 26 passing therethrough, the cleaning electric field Ec or the holding electric field Eh is formed in the second transfer area TP2. However, an appropriate method may be selected.

Anti-Ghost Control Processing 3

In this exemplary embodiment, the electric field to be formed in the second transfer area TP2 is changed according to whether or not the speed priority mode is selected.

As shown in FIG. 4, when the user turns on the speed-priority mode switch 133, the control device 100 determines that the speed priority mode is selected, and when speed-priority mode switch 133 stays off, the control device 100 determines that the speed priority mode is not selected.

Image Transfer to Sheet

Figure 13:
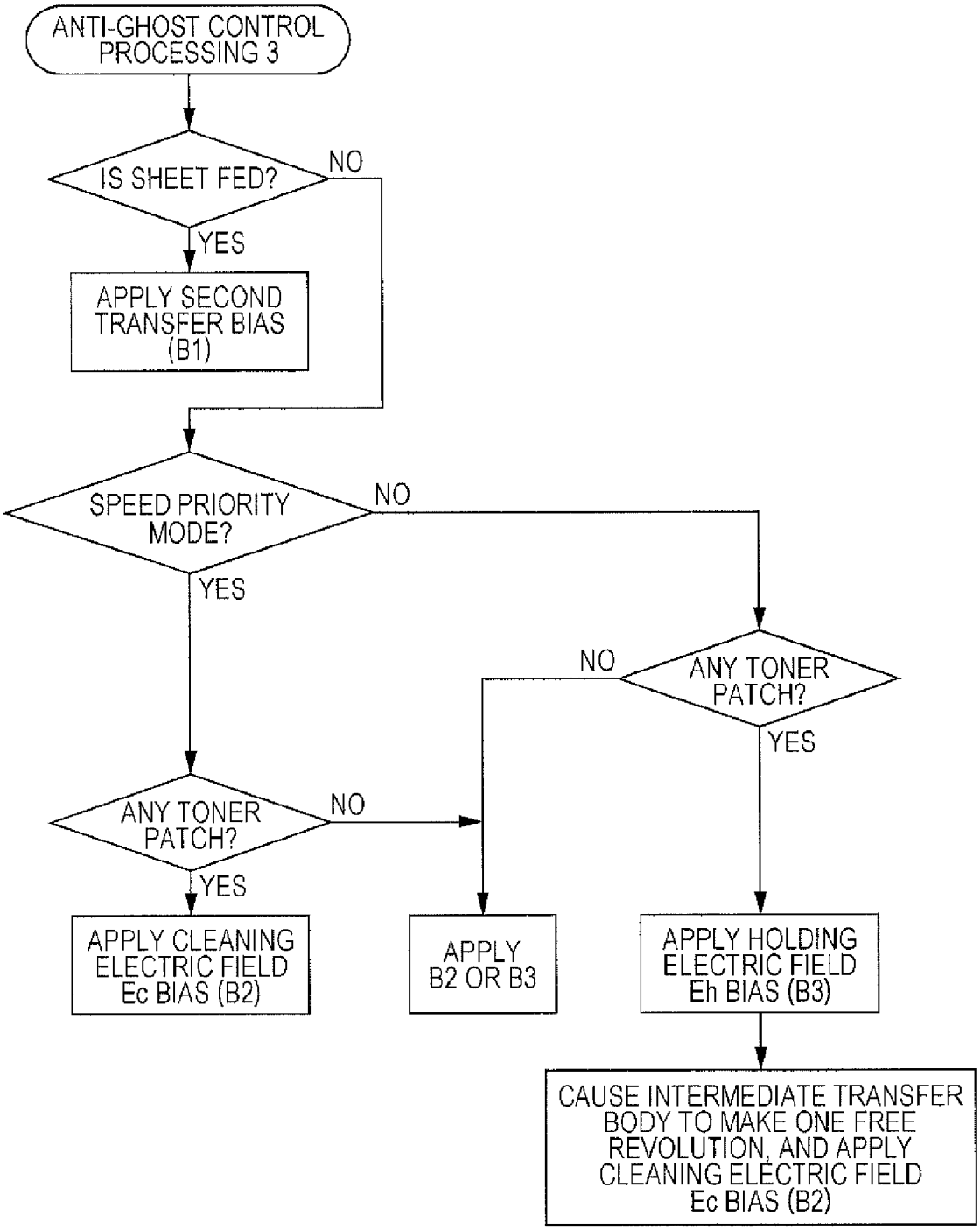
FIG. 13 is a flowchart of anti-ghost control processing 3 performed in the first exemplary embodiment.

As shown in FIG. 13, when the sheet 26 passes through the second transfer area TP2 (when the sheet 26 is fed), the second transfer bias B1 is applied to the second transfer area TP2, forming the second-transfer electric field E2 in the second transfer area TP2. As shown in FIG. 10A, the image G on the intermediate transfer body 22 is transferred to the sheet 26 and is fixed thereto in the fixing device 27.

When Toner Patch Passes

In this exemplary embodiment, the toner patch G, serving as a process control image, may pass through the second transfer area TP2 without the sheet 26 passing therethrough. When the speed priority mode is selected, as shown in FIG. 13, the cleaning bias B2 is applied to the second transfer area TP2, forming the cleaning electric field Ec. Hence, in the speed priority mode, when the toner patch G passes through the second transfer area TP2, the charge record is reduced, whereby image quality defects due to charge record are avoided.

On the other hand, when the speed priority mode is not selected, as shown in FIG. 13, the holding bias B3 is applied to the second transfer area TP2, forming the holding electric field Eh. After that, the control device 100 causes the intermediate transfer body 20 to make one free revolution via the intermediate-transfer-body driving system 103 and applies the cleaning bias B2 to the second transfer area TP2 to form the cleaning electric field Ec in the second transfer area TP2.

Hence, when the speed priority mode is not selected, the risk of the waste toner moving to the second transfer roller 71 is reduced because of the effect of the holding electric field Eh. In addition, because the intermediate transfer body 22 is caused to make one free revolution while being uniformly charged, the charge record remaining in the intermediate transfer body 22, if any, is gradually evened out while the intermediate transfer body 22 makes a free revolution, and the charge record is reduced. Accordingly, there is low risk of image quality defects due to charge record remaining in the intermediate transfer body 22 occurring in the subsequent image-forming job.

In this exemplary embodiment, when the intermediate transfer body 22 is caused to make a free revolution, the cleaning electric field Ec is formed in the second transfer area TP2. However, another electric field may be formed, or the first-transfer electric field E1 or a similar electric field may be formed in any one of the first transfer areas TP1. Furthermore, when the intermediate transfer body 22 carrying no image passes through the second transfer area TP2 without the sheet 26 passing therethrough, the cleaning electric field Ec or the holding electric field Eh is formed in the second transfer area TP2. However, an appropriate method may be selected.

Anti-Ghost Control Processing 4

In this exemplary embodiment, the frequency at which the toner patch passes through the second transfer area is predicted, and the electric field to be formed in the second transfer area TP2 is changed according to the predicted value.

Figure 14:
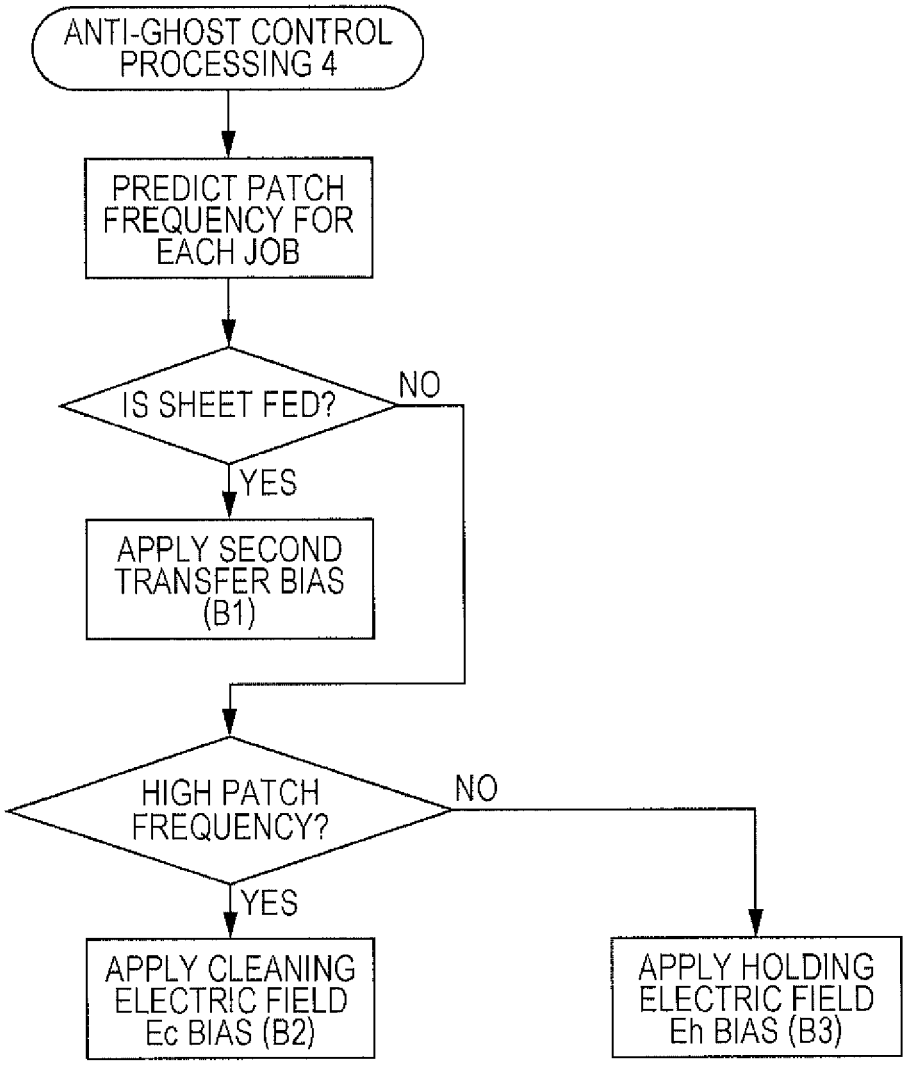
FIG. 14 is a flowchart of anti-ghost control processing 4 performed in the first exemplary embodiment.

As shown in FIG. 14, the control device 100 predicts the patch frequency, i.e., the number of times the toner patch passes through the second transfer area in each job, and determines if the frequency is higher than a predetermined threshold.

Image Transfer to Sheet

As shown in FIG. 14, when the sheet 26 passes through the second transfer area TP2 (when the sheet 26 is fed), the second transfer bias B1 is applied to the second transfer area TP2, forming the second-transfer electric field E2 in the second transfer area TP2. The image G on the intermediate transfer body 22 is transferred to the sheet 26 and is fixed thereto in the fixing device 27.

When Toner Patch Passes

In this exemplary embodiment, the toner patch G, serving as a process control image, may pass through the second transfer area TP2 without the sheet 26 passing therethrough. When the patch frequency is high, as shown in FIG. 14, the cleaning bias B2 is applied to the second transfer area TP2, forming the cleaning electric field Ec. Hence, in the speed priority mode, when the toner patch G passes through the second transfer area TP2, the charge record is reduced, whereby image quality defects due to charge record are avoided.

On the other hand, when the patch frequency is low, as shown in FIG. 14, the holding bias B3 is applied to the second transfer area TP2, forming the holding electric field Eh. In this case, because the patch frequency is low, the charge record is not evident when the toner patch G passes through the second transfer area TP2. Thus, image quality defects due to the image record are not really a problem.

Comparative Example

Figure 15:
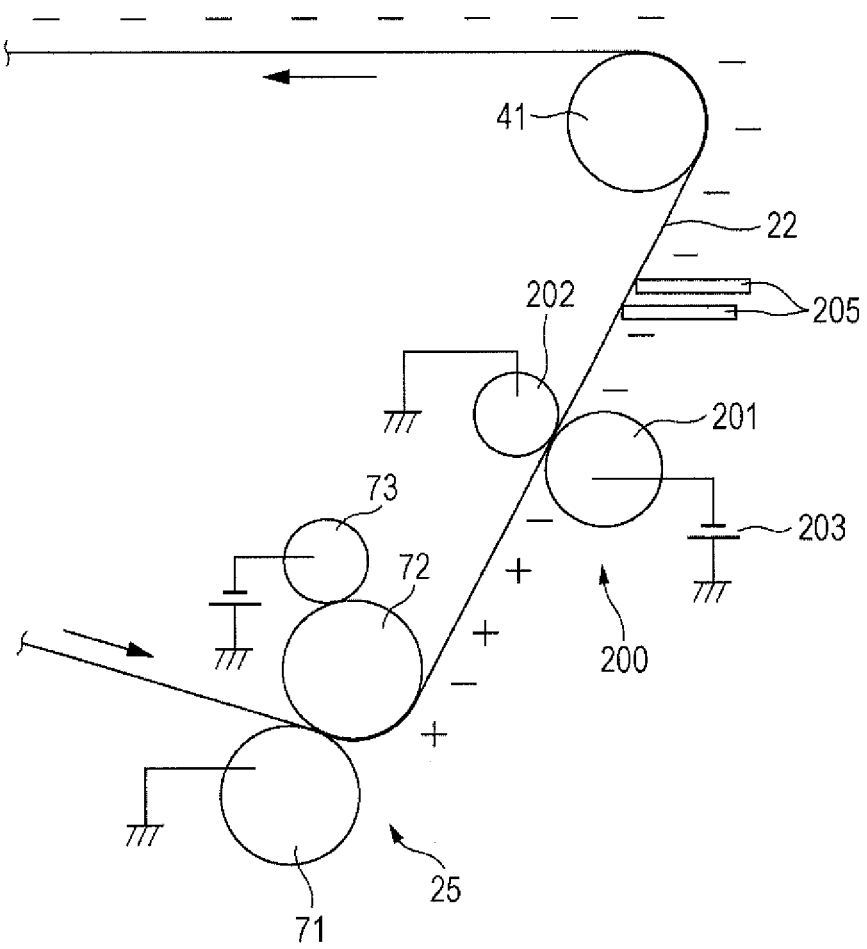
FIG. 15 schematically illustrates an example of anti-ghost control processing performed in an image forming apparatus according to a comparative example.

FIG. 15 shows the relevant part of an image forming apparatus according to a comparative example.

The image forming apparatus shown in FIG. 15 is a tandem image forming apparatus of an intermediate transfer type and includes a static eliminating mechanism 200 disposed downstream of the second transfer area TP2, in the transporting direction of the intermediate transfer body 22.

In this example, the static eliminating mechanism 200 includes a static eliminating roller 201 that is in contact with the outer surface of the intermediate transfer body 22, and an opposing roller 202 provided adjacent to the inner surface of the intermediate transfer body 22 so as to face the static eliminating roller 201. A static-eliminating power supply 203 that applies a static eliminating bias to the static eliminating roller 201 is connected to the static eliminating roller 201 to make the charge record remaining in the intermediate transfer body 22 having passed through the second transfer area TP2 have one polarity (in this example, negative). In FIG. 15, the reference numeral 205 denotes a cleaning device for the intermediate transfer body 22.

In this example, the static eliminating mechanism 200 reduces the charge record remaining in the intermediate transfer body 22. However, the static eliminating mechanism 200 has to be disposed in a space between the second transfer device 25 and the cleaning device 205, which increases the cost and makes it difficult to achieve a compact configuration. Moreover, maintenance of the static eliminating mechanism 200 is required.

EXAMPLE

First Example

This example is a tangible form of the image forming apparatus according to the first example, and the relationship between the volume resistivity of the intermediate transfer body and the ghost grade is studied.

The implementation conditions of this example are as follows:

<Use Environment>

Temperature/humidity: 22° C./55%

Print speed: 445 mm/s

Sheet: OS coat W127 gsm

<First Transfer Device>

First transfer roller: SUS shaft covered with a conductive rubber layer (rubber material: CO and ECO rubbers)

Outside diameter of roller: 24 [mm]

Diameter of roller shaft: 8 [mm]

Resistivity of roller: 6.6 [log Ω] when a voltage of 1000 V is applied

<Second Transfer Device>

Second transfer roller and opposing roller: SUS shaft covered with a conductive rubber layer (rubber material: CO and ECO rubbers)

Outside diameter of second transfer roller: 28 [mm]

Diameter of second transfer roller shaft: 15 [mm]

Resistivity of second transfer roller: 8.0 [log Ω] when a voltage of 1000 V is applied Outside diameter of opposing roller: 20 [mm]

Diameter of opposing roller shaft: 14 [mm]

Resistivity of opposing roller: 6.4 [log Ω] when a voltage of 1500 V is applied

<Intermediate Transfer Body>

Polyimide seamless belt having a thickness of 100 μm, in which carbon black for adjusting resistivity is dispersed.

<Method of Measuring Resistivity of Intermediate Transfer Body>

A method in which a probe is connected to a measuring instrument, and a weight of 19.6 N is attached to the upper portion of the probe to apply a uniform load to belt pieces is employed.

Measuring instrument: Digital ultra-high resistance/micro current meter R8340A (manufactured by ADVANTEST CORPORATION)

Probe: UR probe MCP-HTP12 (DIA INSTRUMENTS CO., LTD.)

In this example, several intermediate transfer bodies having different volume resistivity are prepared, and the presence/absence of image quality defects due to charge record in these intermediate transfer bodies is checked and is evaluated as the ghost grade.

Figure 16:
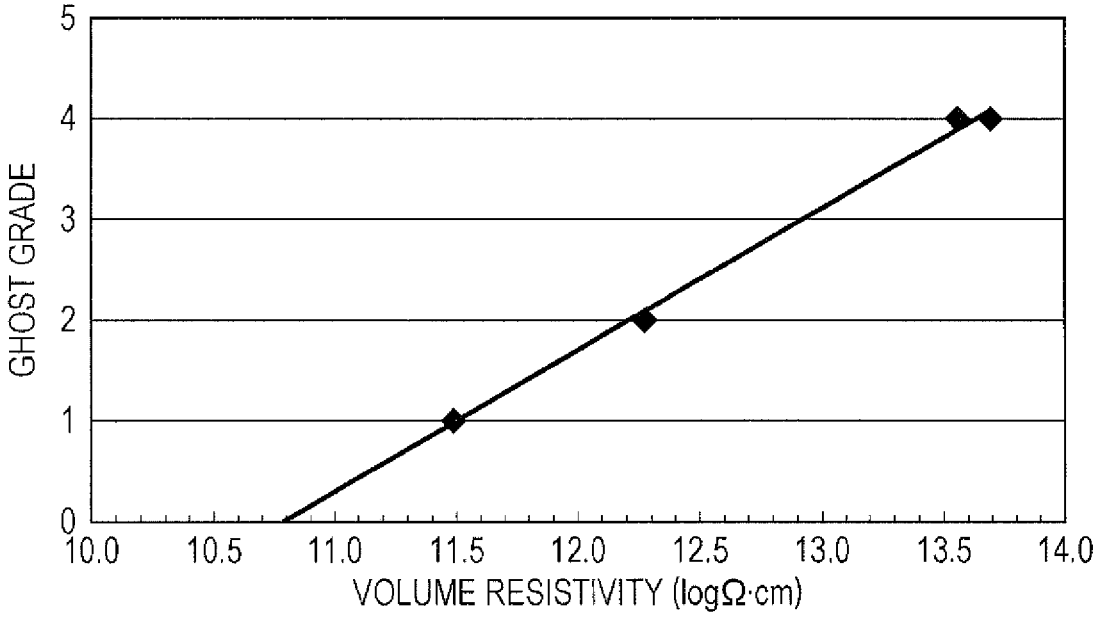
FIG. 16 illustrates the relationship between the volume resistivity of the intermediate transfer body and the ghost grade, in the image forming apparatus according to the first exemplary embodiment.

The result is shown in FIG. 16.

FIG. 16 shows that image quality defects (ghost) due to charge record remaining in the intermediate transfer body occurs in the intermediate transfer bodies having a volume resistivity of 11 [log Ω·cm] or more. This may be because the intermediate transfer bodies having higher volume resistivity have more charge record remaining therein.

Ghost Evaluation Method

The ghost grade used in this example is evaluated on the basis of the ghost evaluation method shown in FIG. 17.

Figure 17A:
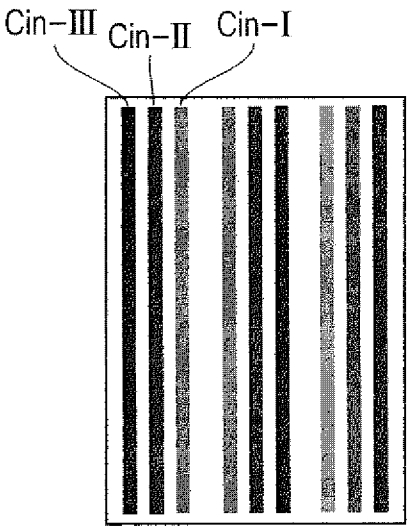
FIG. 17A illustrates a ghost chart used to evaluate the ghost grade in the image forming apparatus according to the first exemplary embodiment.

FIG. 17A shows a ghost chart.

This ghost chart shows several sets of vertical line images corresponding to three types of input density, Cin-I, Cin-II, and Cin-III (in this example, 40%, 70%, and 100%).

Figure 17B:
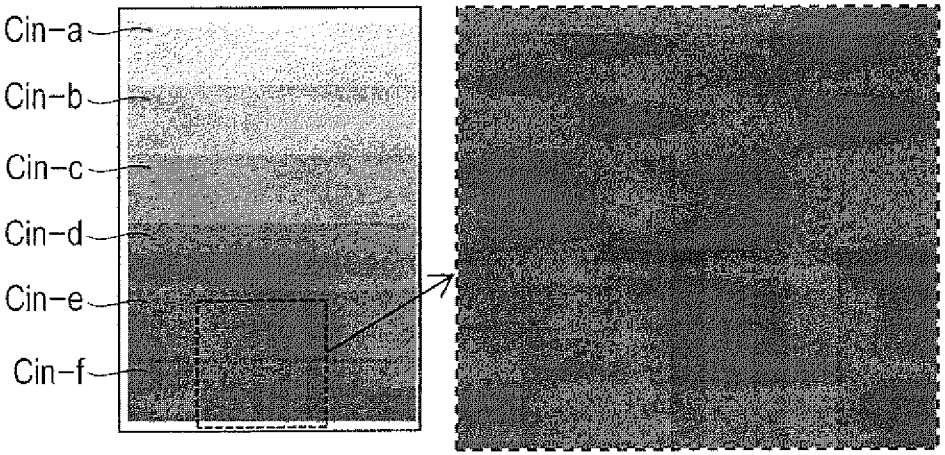
FIG. 17B is a resulting ghost evaluation chart.

FIG. 17B shows a ghost evaluation chart formed in an image-forming job subsequent to forming the ghost chart shown in FIG. 17A.

In this ghost evaluation chart, halftone surface images corresponding to six types of input density, Cin-a, Cin-b, Cin-c, Cin-d, Cin-e, and Cin-f (in this example, 20%, 30%, 40%, 50%, 60%, and 70%), are arranged in the transverse direction orthogonal to the vertical line images.

The ghost grade is evaluated by observing which of the halftone surface images on the ghost evaluation chart, corresponding to the respective input densities, exhibits image quality defects (ghost) due to charge record of the line images on the ghost chart.

In the ghost evaluation chart in FIG. 17B, image defects (ghost) are observed in the halftone images having high input densities (Cin-e and Cin-f).

Second Example

This example is a tangible form of the image forming apparatus according to the first example, and the relationship between the current supplied to the first transfer area and the surface potential of the intermediate transfer body, as well as the relationship between the voltage applied to the second transfer area and the surface potential of the intermediate transfer body, are studied.

In this example, although the first and second transfer devices are the same as those used in the first example, the intermediate transfer body has a volume resistivity of 13.6 (log Ω·cm).

The surface potential of the intermediate transfer body during driving is measured while the apparatus is operating, using a surface electrometer provided on the opposite side, at a position about 1 mm away from the intermediate transfer body, in a state in which the stretching roller 41 shown in, for example, FIG. 4 is grounded. The surface potential is measured using, for example, a surface electrometer MODEL 344, manufactured by TREK Japan KK.

Figure 18A:
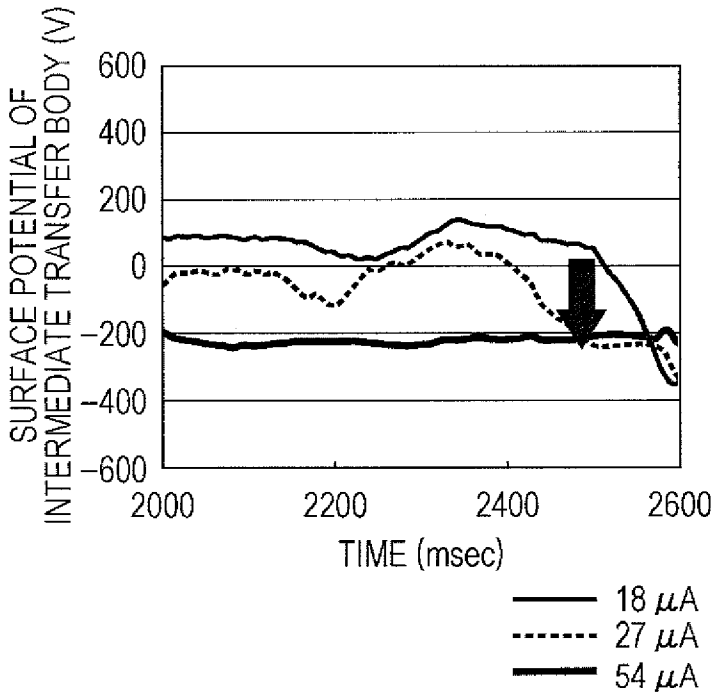
FIG. 18A illustrates the relationship between a current supplied to a first transfer area and the surface potential of an intermediate transfer body of an image forming apparatus according to a second exemplary embodiment.
Figure 18B:
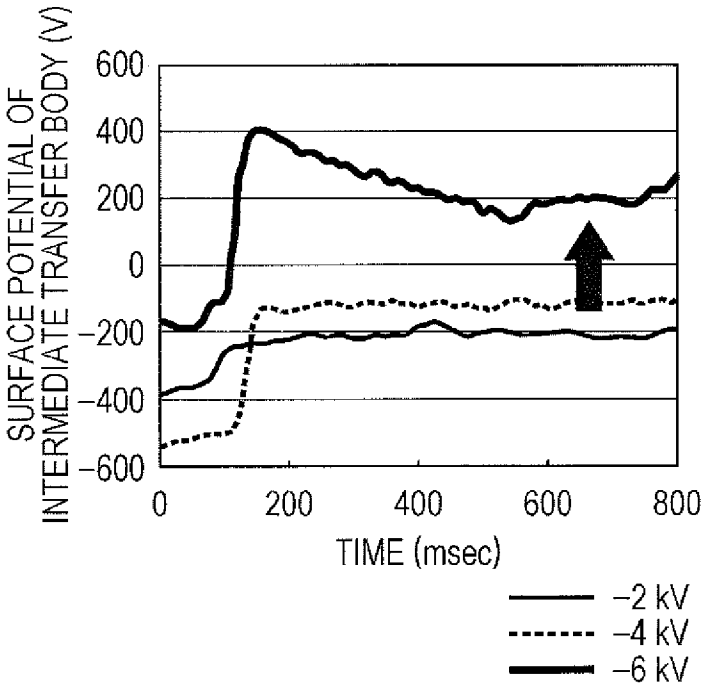
FIG. 18B illustrates the relationship between a bias applied to a second transfer area and the surface potential of the intermediate transfer body of the image forming apparatus according to the second exemplary embodiment.

The results are shown in FIGS. 18A and 18B.

FIG. 18A shows the relationship between the current supplied to the first transfer area and the surface potential of the intermediate transfer body.

FIG. 18A shows that, as the current supplied to the first transfer area is increased to 18 μA, 27 μA, and 54 μA, the surface potential of the intermediate transfer body gradually decreases.

FIG. 18B shows the relationship between the voltage (bias) to be applied to the second transfer area and the surface potential of the intermediate transfer body.

FIG. 18B shows that, as the absolute value of the voltage (bias) applied to the second transfer area is increased to −2 kV, −4 kV, −6 kV, the surface potential of the intermediate transfer body gradually increases.

Furthermore, in this example, the relationship between the current supplied to the first transfer area and the surface charge of the intermediate transfer body, as well as the relationship between the voltage applied to the second transfer area and the surface charge of the intermediate transfer body, are studied. Results are shown in FIGS. 19A and 19B.

Figure 19A:
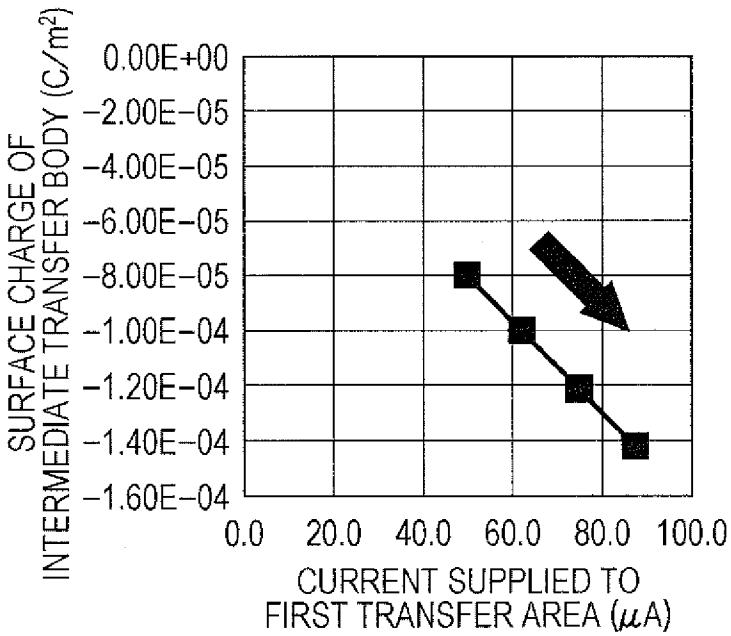
FIG. 19A illustrates a change in surface charge of the intermediate transfer body of the image forming apparatus according to the second exemplary embodiment occurring when a current supplied to the first transfer area is increased.
Figure 19B:
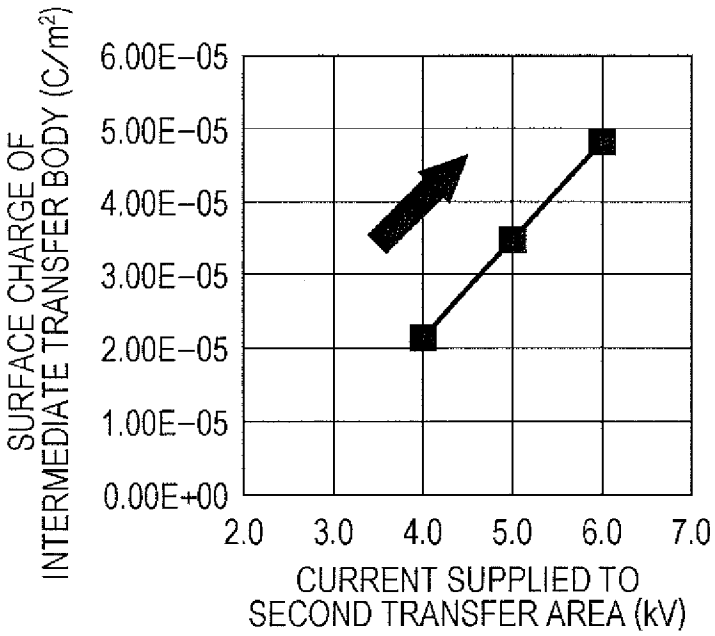
FIG. 19B illustrates a change in the surface charge of the intermediate transfer body of the image forming apparatus according to the second exemplary embodiment occurring when a bias applied to the second transfer area is increased.

FIG. 19A shows the relationship between the current supplied to the first transfer area and the surface charge of the intermediate transfer body.

FIG. 19A shows that, as the current supplied to the first transfer area is gradually increased to about 50 μA to 90 μA, the surface charge of the intermediate transfer body gradually decreases.

FIG. 193 shows the relationship between the voltage (bias) to be applied to the second transfer area and the surface potential of the intermediate transfer body.

FIG. 193 shows that, as the absolute value of the voltage (bias) applied to the second transfer area is increased to −4 kV, −5 kV, and −6 kV, the surface charge of the intermediate transfer body gradually increases.

These results show that the surface potential or surface charge of the intermediate transfer body may be changed by changing the current supplied to the first transfer area or the voltage applied to the second transfer area.

In this example, it is assumed that, by changing the voltage (bias) applied to the second transfer area, the electric field to be formed in the second transfer area is adjusted, contributing to a reduction in the charge, record remaining in the intermediate transfer body.

Third Example

This example is a tangible form of the image forming apparatus according to the first example. This example shows how to determine voltages (bias) applied to the second transfer area to form the second-transfer electric field, the cleaning electric field, and the holding electric field.

Implementation conditions of this example are the same as those in the second example.

Second Transfer Bias B1

Figure 20:
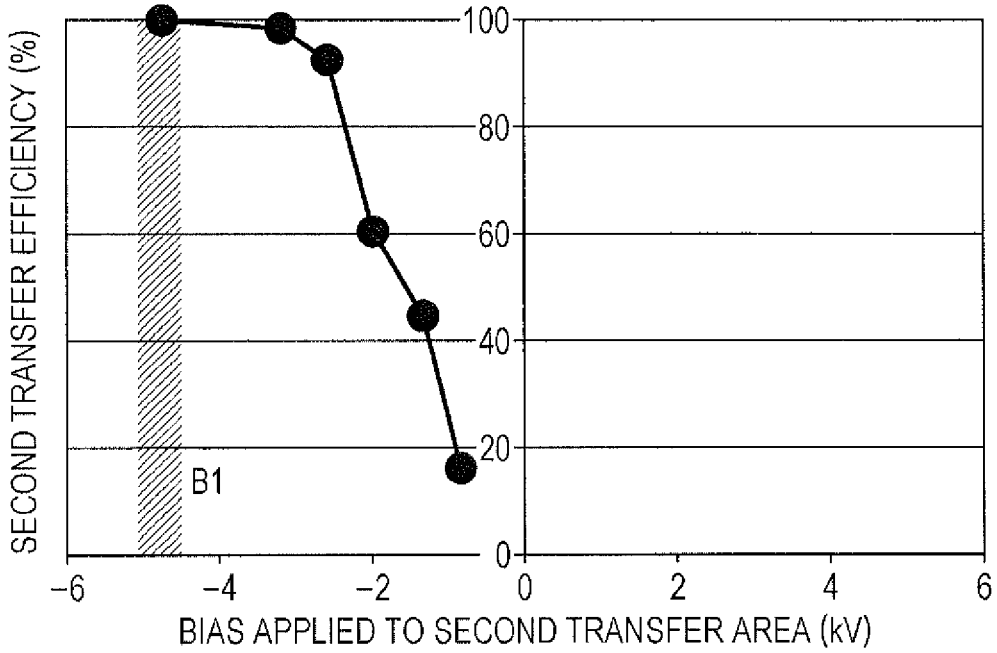
FIG. 20 is a graph showing how to determine the bias B1 applied to form the second-transfer electric field, on the basis of the relationship between the bias applied to the second transfer area and the second transfer efficiency, in an image forming apparatus according to a third exemplary embodiment.

FIG. 20 shows the relationship between the voltage (bias) to be applied to the second transfer area and the second transfer efficiency.

In FIG. 20, the second transfer efficiency is the proportion (percentage) of the amount of image transferred to a sheet in the amount of image on the intermediate transfer body passing through the second transfer area. Because the image is formed with negative toner, a negative voltage (bias) is applied to the second transfer area, and the absolute value thereof is increased. At a voltage of just above −4 kV, the second transfer efficiency reaches nearly 100%.

In this example, a voltage (bias) that achieves substantially 100% second transfer efficiency is selected as the second transfer bias B1 to be applied to the second transfer area. In this example, the second transfer bias B1 is appropriately selected from a range of −4.5 kV to −5 kV.

Cleaning Bias B2

Figure 21:
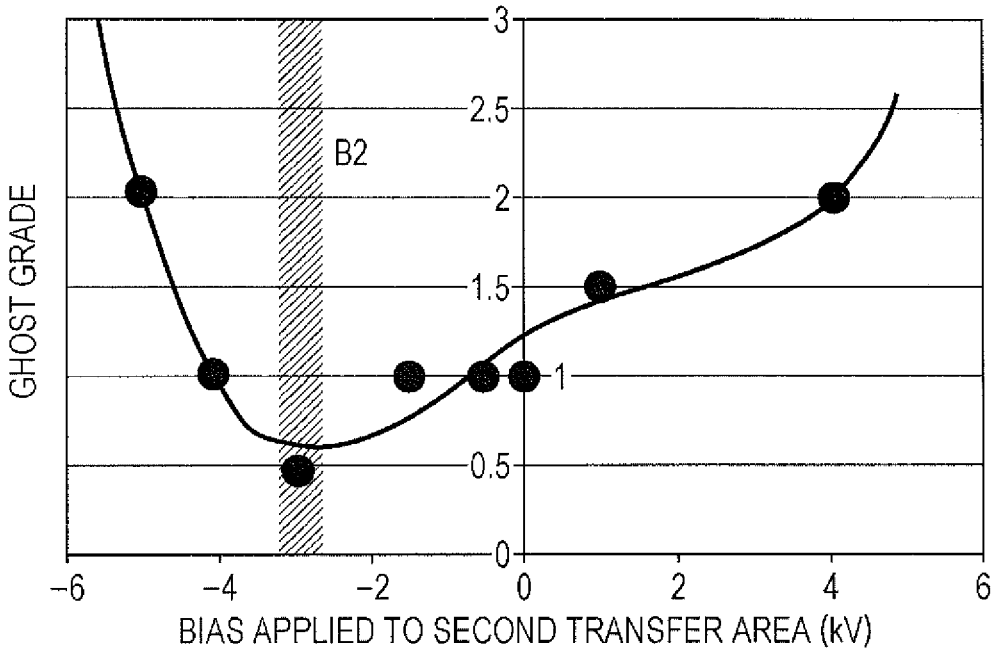
FIG. 21 is a graph showing how to determine the bias B2 applied to form a cleaning electric field, on the basis of the relationship between the bias applied to the second transfer area and the ghost grade, in the image forming apparatus according to the third exemplary embodiment.

FIG. 21 shows the relationship between the voltage (bias) to be applied to the second transfer area and the ghost grade.

Figure 22:
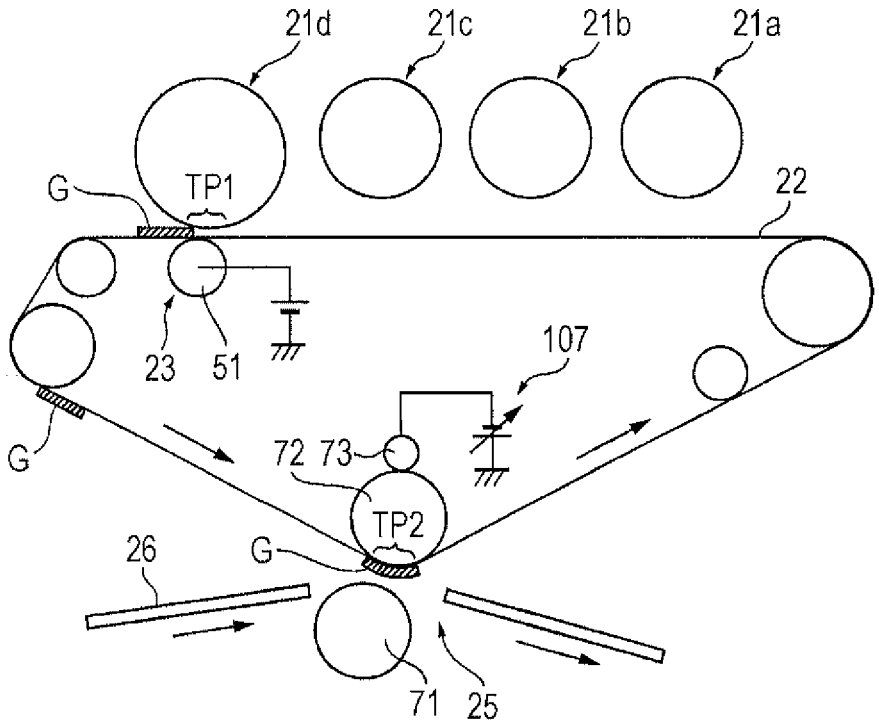
FIG. 22 illustrates the conditions for evaluating the ghost grade shown in FIG. 21.

In this example, as shown in FIG. 22, an image forming operation in the single K mode is performed under the conditions where the temperature is 21° C. and the humidity is 10% RH; the image forming units 21*a* to 21*c* are retracted via the retract mechanism; a toner patch having an input density Cin of 80% is formed using the image forming unit 21*d* corresponding to the black color component; and the toner patch G is allowed to pass through the second transfer area TP2 without the sheet passing therethrough.

During this image forming operation, the ghost grade is measured while varying the voltage (bias) to be applied to the second transfer area TP2.

FIG. 21 shows that the ghost grade shows a peak, or the best result, when a voltage (bias) of about −3 kV, which is lower than the second transfer bias B1, is applied to the second transfer area. The ghost grade gradually gets worse with a voltage (bias) that is either higher or lower than −3 kV.

In this example, a voltage (bias) that achieves good ghost grade, i.e., about −3 kV, is selected as the cleaning bias B2 to be applied to the second transfer area.

When the cleaning bias B2 is applied to the second transfer area, the cleaning electric field Ec is formed in the second transfer area, reducing the charge record remaining in the intermediate transfer body.

Holding Bias B3

Figure 23:
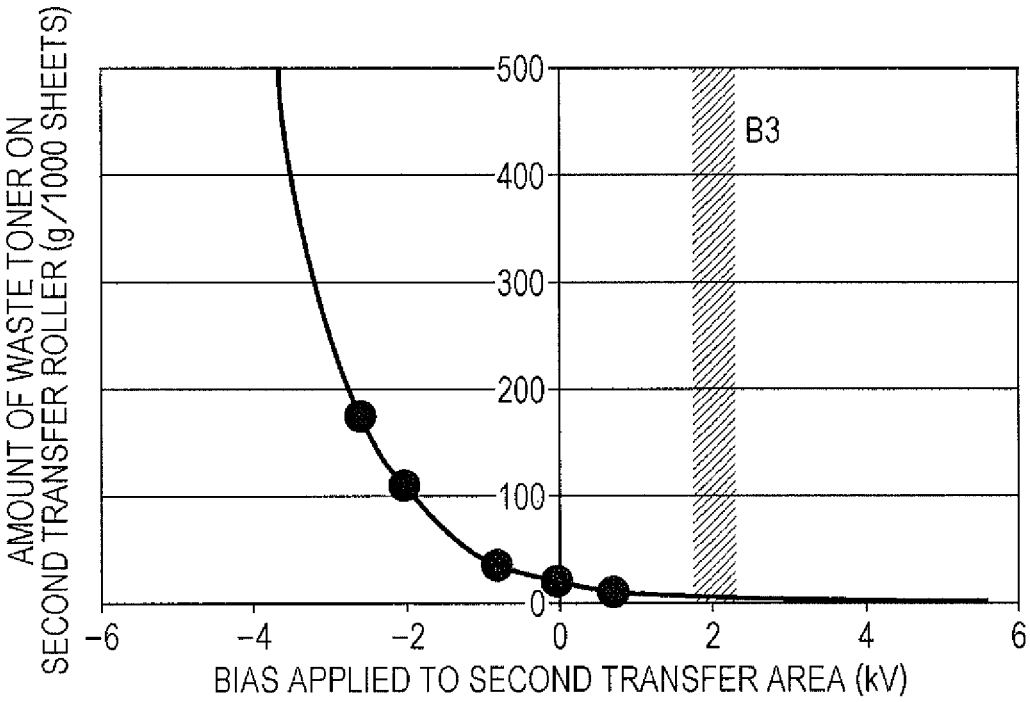
FIG. 23 is a graph showing how to determine the bias B3 applied to form a holding electric field, on the basis of the relationship between the bias applied to the second transfer area and the amount of waste toner on the second transfer roller, in the image forming apparatus according to the third exemplary embodiment.

FIG. 23 shows the relationship between the voltage (bias) to be applied to the second transfer area and the amount of waste toner on the second transfer roller.

As shown in FIG. 22, in this example, the amount of waste toner moved to the second transfer roller 71 after the toner patch G passes through the second transfer area TP2 without the sheet 26 passing therethrough is measured, while varying the voltage (bias) applied to the second transfer area TP2. In FIG. 23, the vertical axis shows the amount of waste toner moved to the second transfer roller 71 per 1000 sheets, when, in the FC mode, a single-color toner patch (inter-image patch) having an input density Cin of 100% and having a predetermined size (for example, 326×106.7 [$mm^2$]) is output between all the sheets.

In this example, when a negative voltage (bias) is applied to the second transfer area, negative toner is used. Thus, it is impossible to completely eliminate the waste toner moving to the second transfer roller 71.

However, when a positive voltage (bias) is applied to the second transfer area TP2, little waste toner moves to the second transfer roller 71, and in this example, at a voltage (bias) of about 2 kV, the amount of waste toner is substantially zero.

In this example, a voltage (bias) that achieves substantially zero waste toner on the second transfer roller, about +2 kV, is selected as the holding bias B3 to be applied to the second transfer area.

When the holding bias B3 is applied to the second transfer area, the holding electric field Eh acts in the second transfer area. Thus, the toner patch G passing through the second transfer area TP2 is securely held on the intermediate transfer body 22 and does not move to the second transfer roller 71 as waste toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image carriers that carry images formed with color component toners;

an intermediate transfer body that is arranged to face the image carriers and is configured to run in a loop, the intermediate transfer body being brought into contact with at least one of the image carriers used for image forming to carry the image formed on the image carrier before transferring the image to a recording material;

a plurality of first transfer devices that include a plurality of first transfer members arranged to face an inner surface of the intermediate transfer body, at positions corresponding to the image carriers, the first transfer devices forming first-transfer electric fields in first transfer areas between the first transfer members and the image carriers to transfer the images carried on the image carriers to the intermediate transfer body;

a second transfer device that includes a second transfer member arranged to face an outer surface of the intermediate transfer body, the second transfer device forms a second-transfer electric field in a second transfer area between the second transfer member and the intermediate transfer body to transfer, to the recording material, the images transferred to the intermediate transfer body by the first transfer devices; and an adjusting device that adjusts an electric field to be formed in the second transfer area to a cleaning electric field, which is of the same polarity as and a lower intensity than the second-transfer electric field, when the image transferred to the intermediate transfer body passes through the second transfer area without recording material passing therethrough.

2. The image forming apparatus according to claim 1, wherein the adjusting device selects a cleaning electric field such that a residual charge difference between an image portion and a non-image portion of the intermediate transfer body having passed through the second transfer area is less than or equal to a predetermined threshold.

3. The image forming apparatus according to claim 1, further comprising:

a contacting/retracting mechanism that relatively brings the intermediate transfer body into contact with or retracted from the image carriers such that the intermediate transfer body is in contact with the image carrier used for image forming and such that the intermediate transfer body is not in contact with the image carriers that are not used for image forming; and a contact-state selecting device that selects, using the contacting/retracting mechanism, a full contact mode, in which the intermediate transfer body is in contact with all the image carriers, or a partial contact mode, in which the intermediate transfer body is in contact with at least one, but not all, of the image carriers, wherein, when the contact-state selecting device selects the partial contact mode, the adjusting device adjusts the electric field to be formed in the second transfer area to the cleaning electric field, and when the contact-state selecting device selects the full contact mode, the adjusting device adjusts the electric field to be formed in the second transfer area to a holding electric field, which is of opposite polarity to the second-transfer electric field.

4. The image forming apparatus according to claim 3, wherein the image carrier located on a most upstream side, in the moving direction of the intermediate transfer body, forms an image with a less visible color component toner.

5. The image forming apparatus according to claim 3, wherein the image carrier for forming a black toner image is located on a most downstream side in the moving direction of the intermediate transfer body and is in contact with the intermediate transfer body to be used to form an image, in either image forming state in which one image carrier is used or in which a plurality of image carriers are used.

6. The image forming apparatus according to claim 1, further comprising an image-quality selecting device that selects image-quality priority processing, in which the priority is given to the quality of the transferred image, wherein, when the image-quality selecting device selects the image-quality priority processing, the adjusting device adjusts the electric field to be formed in the second transfer area to the cleaning electric field, and wherein, when the image-quality selecting device does not select the image-quality priority processing, the adjusting device adjusts the electric field to be formed in the second transfer area to a holding electric field, which is of opposite polarity to the second-transfer electric field.

7. The image forming apparatus according to claim 1, further comprising a speed selecting device that selects, according to the type of the image to be formed, the speed of the image-forming processing performed on the image carriers and the intermediate transfer body during the image forming operation, wherein, when the speed selecting device selects speed priority processing, in which an image forming operation is performed at a speed higher than a predetermined speed, the adjusting device adjusts the electric field to be formed in the second transfer area to the cleaning electric field, and wherein, when the speed selecting device does not select the speed priority processing, the adjusting device adjusts the electric field to be formed in the second transfer area to a holding electric field, which is of opposite polarity to the second-transfer electric field.

8. The image forming apparatus according to claim 7, further comprising a driving control device that, when the speed selecting device does not select the speed priority processing, causes the adjusting device to form the holding electric field in the second transfer area and then causes the intermediate transfer body to make one free revolution while applying a predetermined electric field to the first transfer area or the second transfer area.

9. The image forming apparatus according to claim 1, further comprising a frequency prediction device that predicts the frequency at which the image transferred to the intermediate transfer body passes through the second transfer area without a recording material passing therethrough, wherein, when the frequency predicted by the frequency prediction device is greater than or equal to a predetermined frequency, the adjusting device adjusts the electric field to be formed in the second transfer area to the cleaning electric field, and when the frequency predicted by the frequency prediction device less than the predetermined frequency, the adjusting device adjusts the electric field to be formed in the second transfer area to a holding electric field, which is of opposite polarity to the second-transfer electric field.

10. The image forming apparatus according to claim 1, wherein, when the intermediate transfer body carrying no image passes through the second transfer area without a recording material passing therethrough, the adjusting device adjusts the electric field to be formed in the second transfer area to the cleaning electric field.

11. The image forming apparatus according to claim 3, wherein the relationship $|B1-B3|>|B1-B2|$ is satisfied, where B1, B2, and B3 are voltages applied to form the second-transfer electric field, the cleaning electric field, and the holding electric field, respectively, in the second transfer area.

12. The image forming apparatus according to claim 1, wherein the intermediate transfer body has a base member and a surface layer, the surface layer having higher surface resistivity than the base member.

13. The image forming apparatus according to claim 1, wherein the second transfer device includes an electric-field forming device that forms the second-transfer electric field in the second transfer area, and wherein the adjusting device serves a dual function as the electric-field forming device.

* * * * *